US008452209B2

(12) United States Patent
Tomita et al.

(10) Patent No.: US 8,452,209 B2
(45) Date of Patent: May 28, 2013

(54) IMAGE FORMING APPARATUS

(75) Inventors: Norio Tomita, Osaka (JP); Yoshikazu Harada, Osaka (JP); Yoshiteru Kikuchi, Osaka (JP); Kohichi Yamauchi, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 322 days.

(21) Appl. No.: 13/005,668

(22) Filed: Jan. 13, 2011

(65) Prior Publication Data

US 2011/0170886 A1 Jul. 14, 2011

(30) Foreign Application Priority Data

Jan. 14, 2010 (JP) ..... 2010-005771

(51) Int. Cl.
*G03G 15/00* (2006.01)

(52) U.S. Cl.
USPC ..... 399/167; 399/53; 399/38; 399/76

(58) Field of Classification Search
CPC ..... G03G 15/30
USPC ..... 399/167, 75, 76, 53, 77, 38
See application file for complete search history.

(56) References Cited

U.S. PATENT DOCUMENTS

| | | | | |
|---|---|---|---|---|
| 7,587,157 | B2 | 9/2009 | Matsuda et al. | |
| 2009/0252540 | A1* | 10/2009 | Tomita et al. | 399/301 |
| 2009/0317148 | A1* | 12/2009 | Ikeda et al. | 399/301 |

FOREIGN PATENT DOCUMENTS

| | | | |
|---|---|---|---|
| JP | 2001-350300 | A | 12/2001 |
| JP | 2004-295094 | A | 10/2004 |
| JP | 2007-226206 | A | 9/2007 |
| JP | 2007-304250 | A | 11/2007 |
| JP | 2008-250124 | A | 10/2008 |

* cited by examiner

*Primary Examiner* — Walter L Lindsay, Jr.
*Assistant Examiner* — Roy Y Yi
(74) *Attorney, Agent, or Firm* — Birch, Stewart, Kolasch & Birch, LLP

(57) ABSTRACT

In an image forming apparatus, a computing unit computes phase shift amounts A(i) for every correction relative phase angle θ(j) based on an amplitude B of a reference compressional wave αa, an amplitude C(i) of a detection compressional wave α(i), and a relative phase angle ϕ(i). A setting unit specifies the phase shift amounts A(i), and sets a correction relative phase angle θ(j) corresponding to the specified phase shift amounts A(i). A correction unit corrects, based on the correction relative phase angle θ(j) set by the setting unit, a relative phase shift between a periodic variation in the circumferential speed of a first image bearing member and a periodic variation in the circumferential speed of a second group image bearing member by operationally controlling at least one of first and second drive units.

6 Claims, 17 Drawing Sheets

IMAGE FORMING APPARATUS

CROSS-REFERENCE TO RELATED APPLICATION

This application claims priority under 35 U.S.C. §119(a) on Patent Application No. 2010-005771 filed in Japan on Jan. 14, 2010, the entire contents of which are herein incorporated by reference.

BACKGROUND OF THE INVENTION

1. Field of the Invention

The present invention relates to an image forming apparatus provided with a plurality of image bearing members that each form a plurality of images, and in particular to an image forming apparatus that is provided with a first group image bearing member including a first image bearing member and a second group image bearing member including a plurality of second image bearing members, the plurality of second image bearing members rotating in coordination with each other, the image forming apparatus stacking a plurality of images on a recording medium such as an intermediate transfer body.

2. Related Art

An image forming apparatus, a so-called tandem-type image forming apparatus, is conventionally known that causes each of a plurality of image bearing members such as photosensitive bodies respectively corresponding to a plurality of images (for example, toner images) to rotate at a fixed circumferential speed, forms a plurality of images by performing an electrophotographic image formation process, for instance, and stacks the plurality of images. For example, if a full color image is formed, toner images of a plurality of colors different from each other (ordinarily, yellow (Y), magenta (M), cyan (C), and black (K) color components) are formed on a plurality of image bearing members corresponding thereto at a coordinated timing, the toner images are transferred and stacked on a recording medium such as an intermediate transfer body or a recording material (for example, a sheet), and the stacked images are further transferred to a recording material when the recording medium is an intermediate transfer body.

Even if a plurality of images are respectively formed on a plurality of image bearing members at a coordinated timing, the images may be misaligned when the images on the image bearing members are stacked. It is important to accurately stack the images on the image bearing members in order to prevent such image misalignment from occurring.

An example of a factor causing image misalignment is a phase shift of rotational irregularity due to a periodic variation in a circumferential speed caused by eccentricity of the image bearing members, eccentricity of drive transmission rotation members such as drive gears that transmit rotational drive from driving units to the image bearing members, or the like.

With regard to this point, JP 2006-78850A discloses an image forming apparatus that detects a width or an interval between a reference color line and a detection color line, and computes an amount of positional displacement of a detection color relative to a reference color based on the detected width or interval. When adjusting the rotation phase of a detection color image bearing member with respect to the rotation phase of a reference color image bearing member so as to have a phase relationship determined as being optimal, a position displacement amount detection process for detecting the amount of position displacement of the detection color relative to the reference color by fixing the rotation phase of the reference color image bearing member and adjusting the rotation phase of the detection color image bearing member with respect to the rotation phase of the reference color image bearing member for every predetermined angle is performed during at least one cycle or more including drive irregularity of the image bearing member. Based on the amplitude of the detected amount of position displacement and the rotation phase relationship of the detection color with respect to the reference color, the rotation phase relationship of the detection color with respect to the reference color in which the amplitude of the amount of position displacement is minimal is obtained, and the obtained rotation phase relationship is used as the phase relationship determined as being optimal.

The image forming apparatus disclosed in JP 2006-78850A described above is provided with motors that individually drive the image bearing members, and a relative phase shift between a periodic variation in the circumferential speed of the reference color image bearing member (specifically, a black photosensitive drum) and a periodic variation in the circumferential speed of each of a plurality of detection color image bearing members (specifically, yellow, magenta, and cyan photosensitive drums) can be optimally corrected by individually adjusting the motors. However, if the plurality of detection color image bearing members rotate in coordination with each other, the following problem may occur.

Specifically, there are cases where the conventional image forming apparatus independently drives a first group image bearing member including a first image bearing member among a plurality of image bearing members that each form a plurality of images, and a second group image bearing member that includes a plurality of second image bearing members among the remaining image bearing members.

More specifically, when monochrome image forming is performed, ordinarily a black image is formed independently without an image of another color being formed. In this case, the first image bearing member corresponding to black (for example, a black photosensitive drum) and an image forming member (a member including a black development apparatus) for forming an image on the first image bearing member are driven by a first driving unit different from that for the plurality of second image bearing members (for example, yellow, magenta, and cyan photosensitive drums) respectively corresponding to other images (yellow, magenta, and cyan images) and image forming members (members including yellow, magenta, and cyan development apparatuses) for forming images on the plurality of second image bearing members. Note that a stepping motor is an example of drive units that drive image bearing members and image forming members.

Meanwhile, it is necessary to drive image bearing members and image forming members for images in colors other than black (for example, yellow, magenta, and cyan images), and in order to reduce the number of drive components so as to realize a smaller size for the image forming apparatus, if a plurality of second image bearing members that rotate in coordination with each other (for example, yellow, magenta, and cyan photosensitive drums) and image forming members corresponding to the second image bearing members are driven simultaneously by a common (single) second driving unit, it is possible to reduce the number of components.

Thus, in an image forming apparatus having a configuration in which a plurality of second image bearing members rotate in coordination with each other, as described above, if position displacement in the circumferential direction due to a periodic variation in the circumferential speed caused by eccentricity of the first image bearing member, eccentricity of each of the plurality of second image bearing members, eccentricity of a drive transmission rotation member such as a drive gear that transmits rotational drive from a first driving unit to the first image bearing member, eccentricity of each drive transmission rotation member such as drive gears that transmit rotational drive from a second driving unit to the plurality of second image bearing members, or the like occurs, since the plurality of second image bearing members (for example, the yellow, magenta, and cyan photosensitive drums) in a second group photosensitive body rotate in coordination with each other, a relative phase shift due to a periodic variation in the circumferential speed cannot be adjusted for each other between the plurality of second image bearing members. Moreover, a relative phase shift between the first image bearing member (for example, black photosensitive drum) and each of the plurality of second image bearing members also cannot be adjusted separately.

Accordingly, it is necessary to optimally correct a relative phase shift between a periodic variation in the circumferential speed of the first image bearing member and a periodic variation in the circumferential speed of the second group image bearing member (periodic variation in the circumferential speed of the plurality of second image bearing members that cannot be adjusted for each other).

SUMMARY OF THE INVENTION

An object of the present invention is to provide an image forming apparatus that is provided with a first group image bearing member including a first image bearing member among a plurality of image bearing members that each form a plurality of images, and a second group image bearing member including a plurality of second image bearing members among the remaining image bearing members, the plurality of second image bearing members rotating in coordination with each other, the image forming apparatus stacking the plurality of images on a recording medium and being capable of optimally correcting a relative phase shift between a periodic variation in the circumferential speed of the first image bearing member and a periodic variation in the circumferential speed of the second group image bearing member.

An image forming apparatus according to the present invention is an image forming apparatus that includes a first group image bearing member including a first image bearing member among a plurality of image bearing members each forming a plurality of images, and a second group image bearing member including a plurality of second image bearing members among remaining image bearing members, the plurality of second image bearing members rotating in coordination with each other, the image forming apparatus stacking the plurality of images on a recording medium, and including a first drive unit that rotates the first group image bearing member at a fixed circumferential speed, a second drive unit that rotates the second group image bearing member at the circumferential speed, a pattern formation unit that forms a reference pattern corresponding to the first image bearing member on the recording medium at a pitch in a circumferential direction, and forms a plurality of detection patterns respectively corresponding to the plurality of second image bearing members on the recording medium at the pitch, a detection unit that detects an amplitude of a reference compressional wave representing a periodic change in an amount of position displacement indicating position displacement in the circumferential direction due to the circumferential speed in the reference pattern, detects an amplitude of each of a plurality of detection compressional waves respectively representing a periodic change in an amount of position displacement indicating position displacement in the circumferential direction due to the circumferential speed in the plurality of detection patterns, and further detects a relative phase angle of each of the plurality of detection compressional waves relative to the reference compressional wave, a computing unit that computes, based on the amplitude of the reference compressional wave, the amplitudes of the plurality of detection compressional waves, and the relative phase angles of the plurality of detection compressional waves relative to the reference compressional wave, a plurality of phase shift amounts respectively indicating a relative phase shift of a periodic variation in the circumferential speed of the plurality of second image bearing members in the second group image bearing member relative to a periodic variation in the circumferential speed of the first image bearing member for each of a plurality of correction relative phase angles obtained by sequentially adding a unit angle set in advance, a setting unit that specifies the plurality of phase shift amounts computed for each of the plurality of correction relative phase angles, and sets a correction relative phase angle corresponding to the specified phase shift amounts, and a correction unit that corrects, based on the correction relative phase angle set by the setting unit, a relative phase shift between the periodic variation in the circumferential speed of the first image bearing member and the periodic variation in the circumferential speed of the second group image bearing member by operationally controlling at least one of the first and second drive units.

According to the image forming apparatus having such a configuration, the computing unit computes, based on the amplitude of the reference compressional wave, the amplitudes of the plurality of detection compressional waves, and the relative phase angles of the plurality of detection compressional waves relative to the reference compressional wave, a plurality of phase shift amounts respectively indicating a relative phase shift of a periodic variation in the circumferential speed of the plurality of second image bearing members in the second group image bearing member relative to a periodic variation in the circumferential speed of the first image bearing member for each of a plurality of correction relative phase angles, the setting unit sets a correction relative phase angle corresponding to the phase shift amounts obtained by specifying the plurality of phase shift amounts computed for each of the plurality of correction relative phase angles, and the correction unit corrects, based on the correction relative phase angle set by the setting unit, a relative phase shift between the periodic variation in the circumferential speed of the first image bearing member and the periodic variation in the circumferential speed of the second group image bearing member by operationally controlling at least one of the first and second drive units. Accordingly, it is possible to optimally correct a relative phase shift between a periodic variation in the circumferential speed of the first image bearing member and a periodic variation in the circumferential speed of the second group image bearing member.

In the present invention, an aspect can be given as an example in which when the amplitude of the reference compressional wave is B, the amplitude of each of the plurality of detection compressional waves is C(i) (i being an integer of one or more and m or less, and m being an integer of two or more), the relative phase angle of each of the plurality of detection compressional waves relative to the reference compressional wave is $\phi(i)$, and the plurality of correction relative phase angles are $\theta(j)$ (j being an integer of one or more and n or less, and n being an integer of two or more), the computing unit computes the plurality of phase shift amounts A(i) for each of the plurality of correction relative phase angles using an equation as follows:

$$A(i)=\sqrt{(B^2+C(i)^2-2\times B\times C(i)\times\cos(\phi(i)+\theta(j)))}$$

In this aspect, the plurality of phase shift amounts can be obtained with a simple computing equation, and thus it is possible to realize further facilitation of the computational configuration for computation.

In the image forming apparatus of the present invention, an aspect can be given as an example in which the computing unit calculates an average value for each of the plurality of correction relative phase angles with respect to the plurality of phase shift amounts, and the setting unit sets a correction relative phase angle corresponding to a minimal value among the average values for the plurality of correction relative phase angles calculated by the computing unit.

In this aspect, an optimal correction relative phase angle can be easily set by only selecting the minimal value among the average values calculated for the plurality of correction relative phase angles with respect to the plurality of phase shift amounts, and thus it is possible to realize further facilitation of the computational configuration for computation.

In the image forming apparatus of the present invention, an aspect can be given as an example in which the computing unit calculates a maximal value for each of the plurality of correction relative phase angles with respect to the plurality of phase shift amounts, and the setting unit sets a correction relative phase angle corresponding to a minimal value among the maximal values for the plurality of correction relative phase angles calculated by the computing unit.

In this aspect, an optimal correction relative phase angle can be easily set by only selecting the minimal value among the maximal values calculated for the plurality of correction relative phase angles with respect to the plurality of phase shift amounts, and thus it is possible to realize further facilitation of the computational configuration for computation.

In the image forming apparatus of the present invention, it is preferable that the unit angle is an angle obtained by equally dividing an angle corresponding to at least a single rotation of the image bearing members.

In this case, the plurality of phase shift amounts can be accurately obtained by setting the unit angle so as to be an angle obtained by equally dividing the angle corresponding to at least a single rotation of the image bearing members.

In the image forming apparatus of the present invention, when an image is formed, black is a color for printing characters in many cases, and thus it is preferable that the first group image bearing member performs black image formation, and the second group image bearing member performs color image formation in consideration of improvement in image quality of character originals. Specifically, it is preferable that the first group image bearing member is for performing black image formation, and the second group image bearing member is for performing color image formation.

As described above, according to the image forming apparatus according to the present invention, based on the amplitude of the reference compressional wave, the amplitudes of the plurality of detection compressional waves, and the relative phase angles of the plurality of detection compressional waves relative to the reference compressional wave, the plurality of phase shift amounts are computed for each of the plurality of correction relative phase angles, and the plurality of phase shift amounts computed for each of the plurality of correction relative phase angles are specified. Moreover, a correction relative phase angle corresponding to the specified phase shift amounts is set, and based on the correction relative phase angle, a relative phase shift between the periodic variation in the circumferential speed of the first image bearing member and the periodic variation in the circumferential speed of the second group image bearing member is corrected by operationally controlling at least one of the first and second drive units. Accordingly, it is possible to optimally correct a relative phase shift between a periodic variation in the circumferential speed of the first image bearing member and a periodic variation in the circumferential speed of the second group image bearing member.

BRIEF DESCRIPTION OF THE DRAWINGS

FIG. 15A is a diagram showing both the black reference pattern and the cyan detection pattern in the state where there is no relative phase shift between a black reference compressional wave and the cyan detection compressional wave in the case where the amplitudes thereof are the same, FIG. 15B is a diagram showing both the black reference pattern and the cyan detection pattern in the state where there is a relative phase shift between the black reference compressional wave and the cyan detection compressional wave in the case where the amplitudes thereof are the same, FIG. 15C is a diagram showing a state in which the cyan detection compressional wave having a different amplitude is shifted by a relative phase angle relative to the black reference compressional wave, and FIG. 15D is a diagram in which the black reference compressional wave and the cyan detection compressional wave shown in FIG. 15C are represented in circular movement.

FIG. 16A is a diagram showing that the amplitude of the black reference compressional wave, the amplitude of the cyan detection compressional wave, and the relative phase angle have a relationship corresponding to two sides of a triangle and an angle formed thereby, and FIG. 16B is a diagram showing an example of a waveform representing a relative phase shift amount of rotational irregularity of the cyan photosensitive drum relative to rotational irregularity of a black photosensitive drum when the relative phase angle of the cyan detection compressional wave relative to the black reference compressional wave is 0°.

FIG. 19C is a diagram showing a state after correcting a relative phase shift between rotational irregularity of the black photosensitive drum and rotational irregularity of the second group photosensitive body.

FIG. 20A is a graph after correction is performed in a first setting mode, and FIG. 20B is a graph after correction is performed in a second setting mode.

DESCRIPTION OF PREFERRED EMBODIMENTS

Hereinafter, embodiments according to the present invention will be described with reference to the drawings. Note that the following embodiment is an example of an embodiment of the present invention, and is not intended to limit the technical scope of the present invention.

Figure 1:
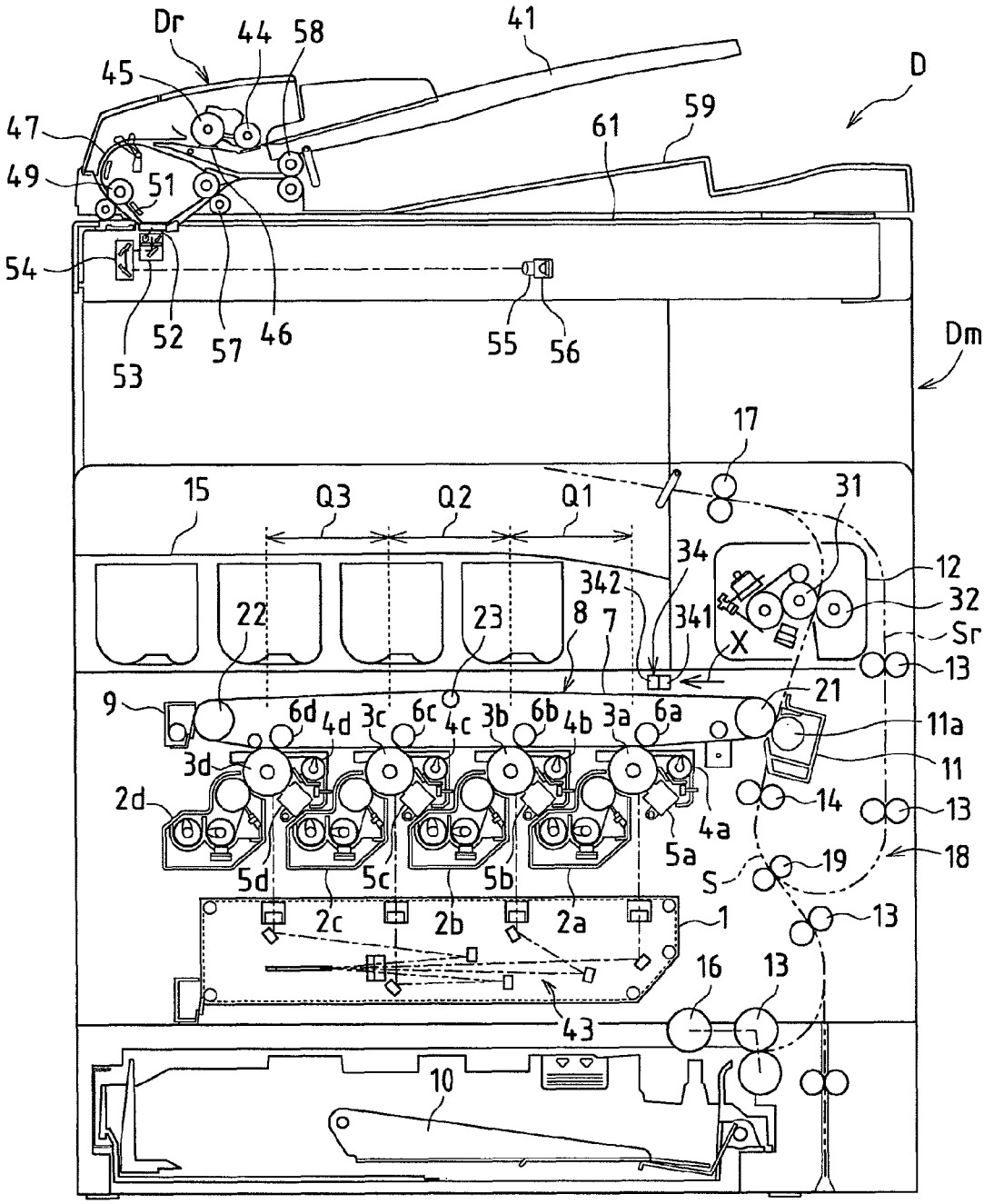
FIG. 1 is a cross-sectional view schematically showing a color image forming apparatus according to an embodiment of the present invention.

FIG. 1 is a lateral view schematically showing a color image forming apparatus D according to an embodiment of the present invention.

The color image forming apparatus D shown in FIG. 1 is provided with an original document reading apparatus Dr that reads an image of an original, and an apparatus main body Dm that records/forms the original image read by the original reading apparatus Dr or an image received from outside on a recording material such as standard paper, as a color image or as a monochrome image.

In the original reading apparatus Dr, when an original is placed on an original setting tray 41, a pickup roller 44 is pressed against the surface of the original and rotated, and thus the original is drawn out from the tray 41, passes between a separation roller 45 and a separation pad 46 to be separated page-by-page, and then is transported to a transport path 47.

In the transport path 47, a leading edge of the original abuts against a registration roller 49 and is aligned parallel to the registration roller 49, and then the original is transported by the registration roller 49 and passes between an original guide 51 and a reading glass 52. At this time, the original surface is irradiated with light from a light source of a first scanning unit 53 via the reading glass 52, the light reflected thereby is incident on the first scanning unit 53 via the reading glass 52, this reflected light is reflected by mirrors of the first scanning unit 53 and a second scanning unit 54 and guided to an imaging lens 55, and thus an image of the original surface is formed on a CCD (charge coupled device) 56 by the imaging lens 55. The CCD 56 reads the image of the original surface and outputs image data indicating that image. Furthermore, the original is transported by a transport roller 57, and discharged to an original discharge tray 59 via a discharge roller 58.

Further, the original document reading apparatus Dr is capable of reading an original that has been placed on an original stage glass 61. The registration roller 49, the original guide 51, the original discharge tray 59 and so forth, and members on the upper side thereof are a single integrated cover body, and the cover body is pivotably supported to be openable and closable around an axial line in the sub-scanning direction at a rear surface side of the original reading apparatus Dr. When this cover body on the upper side is opened, the original stage glass 61 is released, and an original can be placed on the original stage glass 61. When the cover body is closed, the original placed on the original stage glass 61 is held by the cover body. When there is an original reading instruction, the original surface on the original stage glass 61 is exposed to light by the first scanning unit 53 while the first scanning unit 53 and the second scanning unit 54 are moved in the sub-scanning direction. The reflected light from the original surface is guided to the imaging lens 55 by the first scanning unit 53 and the second scanning unit 54, an image is formed on the CCD 56 by the imaging lens 55, and here an original image is read. At this time, the first scanning unit 53 and the second scanning unit 54 are moved while maintaining a predetermined speed relationship relative to each other, so that the positional relationship of the first scanning unit 53 and the second scanning unit 54 is always maintained such that there is no change in the length of the optical path of the reflected light from the surface of the original to the CCD 56 via the first scanning unit 53, the second scanning unit 54 and the image forming lens 55. Thus, focus of the image of the original surface on the CCD 56 is always accurately maintained.

The entire original image that has been read in this way is sent to/received by the apparatus main body Dm of the color image forming apparatus D as image data, and the image is recorded on a recording material in the apparatus main body Dm.

On the other hand, the apparatus main body Dm of the color image forming apparatus D forms a plurality of images using photosensitive drums 3 (3*a*, 3*b*, 3*c*, and 3*d*) that operate as a plurality of image bearing members respectively corresponding to the images, and stacks those images. The apparatus main body Dm is provided with an exposure apparatus 1, development apparatuses 2 (2*a*, 2*b*, 2*c*, and 2*d*), the photosensitive drums 3 (3*a*, 3*b*, 3*c*, and 3*d*) disposed in a line in the recording material transport direction, charging units 5 (5*a*, 5*b*, 5*c*, and 5*d*), cleaning apparatuses 4 (4*a*, 4*b*, 4*c*, and 4*d*), an intermediate transfer belt apparatus 8 that includes intermediate transfer rollers 6 (6*a*, 6*b*, 6*c*, and 6*d*) that operate as a transfer unit, a fixing apparatus 12, a transport apparatus 18, a paper feed tray 10 that operates as a paper feed unit, and a discharge tray 15 that operates as a discharge unit.

Image data handled in the apparatus main body Dm of the color image forming apparatus D corresponds to a color image employing each of the colors black (K), cyan (C), magenta (M), and yellow (Y), or corresponds to a monochrome image employing a single color (for example, black). Accordingly, four sets of each of the development apparatuses 2 (2*a*, 2*b*, 2*c*, and 2*d*), the photosensitive drums 3 (3*a*, 3*b*, 3*c*, and 3*d*), the charging units 5 (5*a*, 5*b*, 5*c*, and 5*d*), the cleaner apparatuses 4 (4*a*, 4*b*, 4*c*, and 4*d*), and the intermediate transfer rollers 6 (6*a*, 6*b*, 6*c*, and 6*d*) are provided in order to form four types of images corresponding to the respective colors, thus configuring four image stations. Among the four suffix letters a to d, letter a is associated with black, letter b is associated with cyan, letter c is associated with magenta, and letter d is associated with yellow. In the description below, the suffix letters a to d are omitted.

The photosensitive drums 3 are disposed substantially in the center in the vertical direction of the apparatus main body Dm. The charging units 5 are charging means for uniformly charging the surface of the photosensitive drums 3 to a predetermined electric potential, and other than contact-roller-type charging units or contact-brush-type charging units, charger-type charging units are used.

Here, the exposure apparatus 1 is a laser scanning unit (LSU) provided with laser light sources 42*a* to 42*d* (not shown in FIG. 1, see FIG. 4A described later) and a scanning optical system 43, exposes the charged surface of the photosensitive drums 3 in accordance with the image data, and forms an electrostatic latent image corresponding to the image data on the surface thereof.

The development apparatuses 2 use (K, C, M, and Y) toner to develop the electrostatic latent images formed on the photosensitive drums 3. The cleaner apparatuses 4 remove and collect toner remaining on the surface of the photosensitive drums 3 after development and image transfer.

The intermediate transfer belt apparatus 8 disposed above the photosensitive drums 3 is provided with an intermediate transfer belt (an example of an intermediate transfer body) 7 that operates as a recording medium, an intermediate transfer belt drive roller 21, an idler roller 22, a tension roller 23, and an intermediate transfer belt cleaning apparatus 9, in addition to the intermediate transfer rollers 6.

The intermediate transfer belt 7 is stretched across and supported by roller members, such as the intermediate transfer belt drive roller 21, the intermediate transfer rollers 6, the idler roller 22, and the tension roller 23, which allow the intermediate transfer belt 7 to revolve in a predetermined movement direction (the direction of the arrow X in FIG. 1).

The intermediate transfer rollers 6 are rotatably supported inside the intermediate transfer belt 7, and pressed against the photosensitive drums 3 via the intermediate transfer belt 7. A transfer bias for transferring toner images on the photosensitive drums 3 to the intermediate transfer belt 7 is applied to the intermediate transfer rollers 6.

The intermediate transfer belt 7 is provided so as to be in contact with the photosensitive drums 3. Toner images on the surface of the photosensitive drums 3 are sequentially transferred and superimposed onto the intermediate transfer belt 7, thereby forming a color toner image (toner images of the respective colors). Here, this intermediate transfer belt 7 is formed as an endless belt, using a film having a thickness of about 100 μm to 150 μm.

Toner images are transferred from the photosensitive drums 3 to the intermediate transfer belt 7 by the intermediate transfer rollers 6, which are pressed against the inner side (back surface) of the intermediate transfer belt 7. In order to transfer the toner images, a high voltage transfer bias (high voltage with the opposite polarity (+) to the toner charging polarity (−), for example) is applied to the intermediate transfer rollers 6. The intermediate transfer rollers 6 use a metal (stainless steel, for example) shaft with a diameter of 8 to 10 mm as a base, and the surface of this shaft is covered with conductive elastic material (such as EPDM or urethane foam, for example). By using this conductive elastic material, a high voltage can be uniformly applied to the recording material.

The apparatus main body Dm of the color image forming apparatus D is further provided with a secondary transfer apparatus 11 including a transfer roller 11*a* that operates as a transfer unit. The transfer roller 11*a* is in contact with the opposite side (outside) of the intermediate transfer belt 7 to the intermediate transfer belt drive roller 21.

The toner images on the surface of the photosensitive drums 3 are layered on the intermediate transfer belt 7 as described above and become a color toner image indicated by image data. The toner images of the respective colors stacked in this way are transported along with the intermediate transfer belt 7, and transferred onto the recording material by the secondary transfer apparatus 11.

The intermediate transfer belt 7 and the transfer roller 11*a* of the secondary transfer apparatus 11 are pressed against each other so as to form a nip region. A voltage (high voltage with the opposite polarity (+) to the toner charging polarity (−), for example) is applied to the transfer roller 11*a* of the secondary transfer apparatus 11 in order to transfer the toner images of the respective colors on the intermediate transfer belt 7 to the recording material. Furthermore, in order to constantly obtain the nip region, either one of the transfer roller 11*a* of the secondary transfer apparatus 11 and the intermediate transfer belt drive roller 21 is made of a hard material (metal or the like), and the other roller is made of a soft material, such as an elastic roller (elastic rubber roller, foam resin roller, or the like).

Toner may remain on the intermediate transfer belt 7, without the toner image on the intermediate transfer belt 7 being completely transferred onto the recording material by the secondary transfer apparatus 11. This remaining toner causes toner color mixing to occur in a subsequent step, and therefore the remaining toner is removed and collected by the intermediate transfer belt cleaning apparatus 9. The intermediate transfer belt cleaning apparatus 9 is provided with, for example, a cleaning blade that is in contact with the intermediate transfer belt 7 as a cleaning member, and remaining toner can be removed and collected by this cleaning blade. The idler roller 22 supports the intermediate transfer belt 7 from the inside (back side), and the cleaning blade is in contact with the intermediate transfer belt 7 such that the cleaning blade presses from the outside toward the idler roller 22.

The paper feed tray 10 is a tray for storing recording material, and is provided in the lower part of an image forming unit of the apparatus main body Dm. The discharge tray 15 provided on the upper side of the image forming unit is a tray for placing printed recording material face-down.

Further, the apparatus main body Dm is provided with the transport apparatus 18 for feeding recording material on the paper feed tray 10 to the discharge tray 15 through the second transfer apparatus 11 and the fixing apparatus 12. The transport apparatus 18 has an S-shaped transport path S, and disposed along the transport path S are transport members such as a pickup roller 16, transport rollers 13, a pre-registration roller 19, a registration roller 14, the fixing apparatus 12, a discharge roller 17, and so forth.

The pickup roller 16 is a draw-in roller that is provided at an edge portion on a downstream side in the recording material transport direction of the paper feed tray 10, and supplies recording material one-by-one from the paper feed tray 10 to the sheet transport path S. The transport rollers 13 and the pre-registration roller 19 are small rollers for promoting/assisting transport of the recording material. The transport rollers 13 are provided in a plurality of locations along the transport path S. The pre-registration roller 19 is provided near the upstream side in the transport direction of the registration roller 14, and transports the recording material to the registration roller 14.

The registration roller 14 temporarily stops the recording material transported by the pre-registration roller 19, aligns the leading edge of the recording material, and then transports the recording material in a timely manner, in coordination with rotation of the photosensitive drums 3 and the intermediate transfer belt 7, such that the color toner image on the intermediate transfer belt 7 is transferred to the recording material in the nip region between the intermediate transfer belt 7 and the secondary transfer apparatus 11.

For example, the registration roller 14 transports the recording material, such that the leading edge of the color toner image on the intermediate transfer belt 7 matches the leading edge of an image forming range in the recording material in the nip region between the intermediate transfer belt 7 and the secondary transfer apparatus 11.

The fixing apparatus 12 is provided with a heat roller 31 and a pressure roller 32. The heat roller 31 and the pressure roller 32 sandwich and transport the recording material.

The temperature of the heat roller 31 is controlled so as to be a predetermined fixing temperature. The heat roller 31 has a function for melting, mixing, and pressing the toner image that has been transferred to the recording material so as to thermally fix the toner image onto the recording material by subjecting the recording material to thermocompression bonding in cooperation with the pressure roller 32.

The recording material on which the toner images of the respective colors have been fixed is discharged onto the discharge tray 15 by the discharge roller 17.

It is also possible to form a monochrome image using at least one among the four image forming stations, and transfer the monochrome image to the intermediate transfer belt 7 of the intermediate transfer belt apparatus 8. As in the case of a color image, this monochrome image is transferred from the intermediate transfer belt 7 to a recording material, and fixed on the recording material.

Further, when image formation is performed on not only the front face of the recording material, but both faces, after an image on the front face of the recording material has been fixed by the fixing apparatus 12, the discharge roller 17 is stopped and then rotated in reverse while transporting the recording material by the discharge roller 17 on the sheet transport path S, thereby causing the recording material to pass through a front-back reverse path Sr. After the front and back of the recording material are reversed, the recording material is again led to the registration rollers 14. Similar to the case of performing image formation on the front face of the recording material, an image is recorded and fixed on the back face of the recording material, and the recording material is discharged onto the discharge tray 15.

Configuration of Pattern Detection Sensor

The color image forming apparatus D is further provided with a pattern detection sensor 34. Note that in the following description, the suffix letter of reference numeral 3 indicating photosensitive drums, that of reference numeral 2 indicating development apparatuses, and that of reference numeral 6 indicating transfer units are not omitted. That is, the description below refers to photosensitive drums 3*a*, 3*b*, 3*c*, and 3*d*, development apparatuses (here, development units) 2*a*, 2*b*, 2*c*, and 2*d*, and transfer units (here, intermediate transfer rollers) 6*a*, 6*b*, 6*c*, and 6*d*.

The pattern detection sensor 34 is disposed at the downstream side relative to a photosensitive drum (here, the black photosensitive drum 3*a*) in the movement direction X of the endless intermediate transfer belt 7. Specifically, the pattern detection sensor 34 is disposed so as oppose the surface of the intermediate transfer belt 7.

Here, the pattern detection sensor 34 is a reflective-type light sensor (photo interrupter) that has a light-emitting portion 341 and a light-receiving portion 342. The pattern detection sensor 34 detects patterns Pa to Pd (see FIG. 5 described later) formed on the intermediate transfer belt 7 as described later. Specifically, the pattern detection sensor 34 detects incident light reflected by the surface of the intermediate transfer belt 7 or the patterns Pa to Pd from the light-emitting portion 341 at the light-receiving portion 342.

Configuration of Driving Apparatus

The color image forming apparatus D is further provided with a driving apparatus 100 that drives the photosensitive drums 3 (not shown in FIG. 1, see FIGS. 2 and 3 described later).

Figure 2:
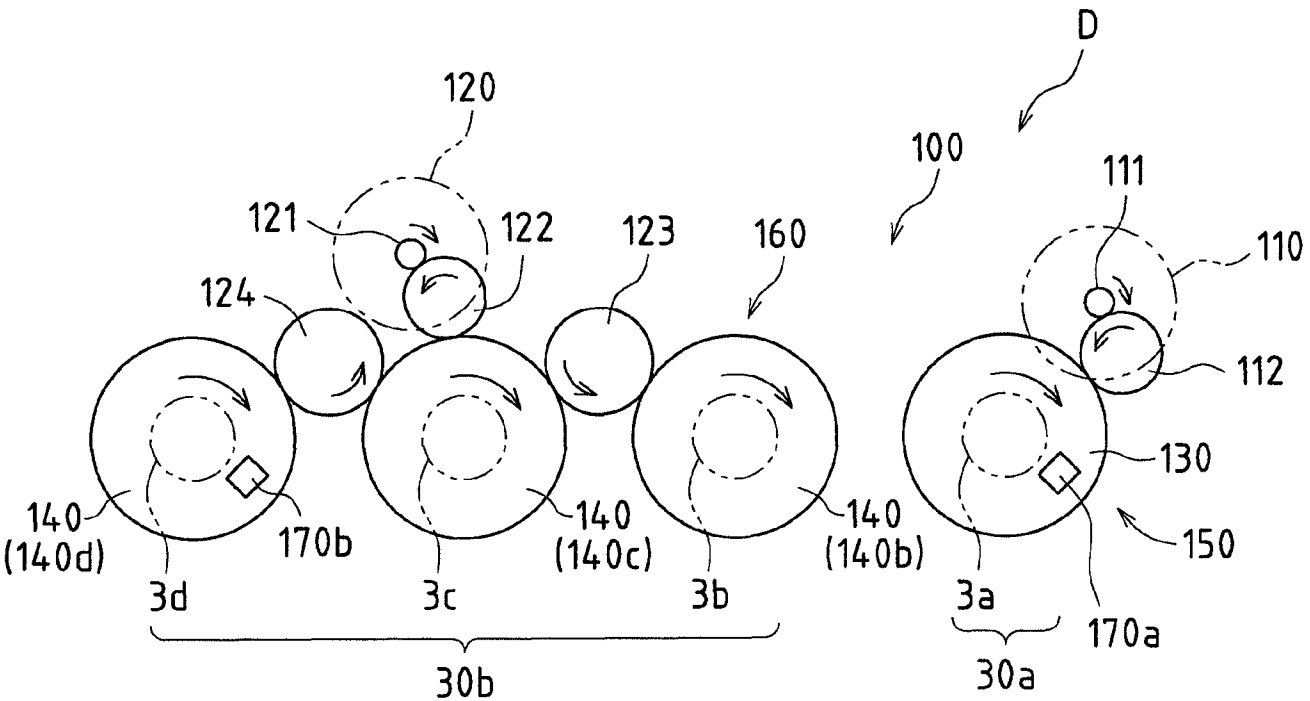
FIG. 2 is a system configuration diagram schematically showing a drive transmission system of a driving apparatus in the color image forming apparatus shown in FIG. 1, and shows a gear train that transmits rotational drive from first and second driving units to photosensitive drums, and first and second phase detection sensors.
Figure 3:
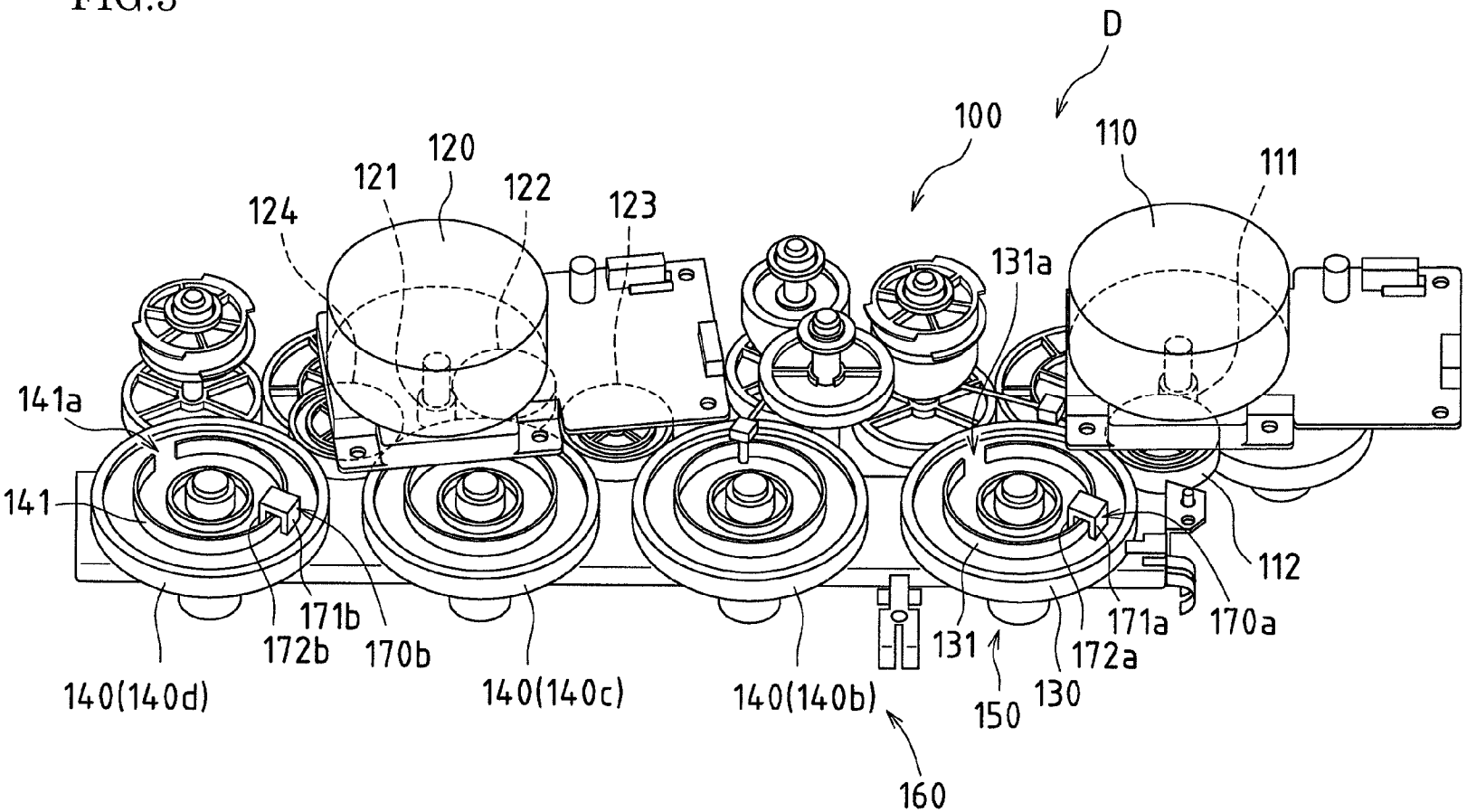
FIG. 3 is a perspective view showing in detail the driving apparatus in the color image forming apparatus shown in FIG. 1.

FIG. 2 is a system configuration diagram schematically showing a drive transmission system of the driving apparatus 100 in the color image forming apparatus D shown in FIG. 1, and shows a gear train that transmits rotational drive from first and second driving units 110 and 120 to the photosensitive drums 3*a*, 3*b*, 3*c*, and 3*d*, and first and second phase detection sensors 170*a* and 170*b*. Further, FIG. 3 is a perspective view showing in detail the driving apparatus 100 in the color image forming apparatus D shown in FIG. 1.

The color image forming apparatus D is provided with a first group photosensitive body 30*a* (an example of a first group image bearing member) including a first photosensitive drum (here, the black photosensitive drum 3*a*) among the photosensitive drums 3*a*, 3*b*, 3*c*, and 3*d*, and a second group photosensitive body 30*b* (an example of a second group image bearing member) including a plurality of remaining second photosensitive drums (here, the cyan photosensitive drum 3*b*, the magenta photosensitive drum 3*c* and the yellow photosensitive drum 3*d*), the second photosensitive drums 3*b*, 3*c*, and 3*d* rotating in coordination with each other. Here, the first group photosensitive body 30*a* is for performing monochrome image formation (monochrome printing), and the second group photosensitive body 30*b* is for performing full color image formation in cooperation with the first group photosensitive body 30*a*. Note that all the photosensitive drums 3*a*, 3*b*, 3*c*, and 3*d* have the same diameter.

The driving apparatus 100 is provided with the first driving unit 110, the second driving unit 120, a first rotation member (here, first drive transmission rotation member) 150, a second rotation member (here, second drive transmission rotation member) 160, and the first and second phase detection sensors 170*a* and 170*b*.

The first driving unit 110 is for driving the first group photosensitive body 30*a*. The second driving unit 120 is for driving the second group photosensitive body 30*b*. Here, the first driving unit 110 and the second driving unit 120 are stepping motors.

The first drive transmission rotation member 150 transmits rotational drive from the first driving unit 110 to the first group photosensitive body 30*a* and here, includes a first shaft gear 111, a first intermediate gear 112, and a black photosensitive body drive gear 130. The second drive transmission rotation member 160 transmits rotational drive from the second driving unit 120 to the second group photosensitive body 30*b* and here, includes a second shaft gear 121, second to fourth intermediate gears 122 to 124, and color (cyan, magenta, and yellow) photosensitive body drive gears 140 (140*b* to 140*d*). Note that the directions of the rotation axes of these gears are parallel to each other.

Specifically, the black photosensitive body drive gear 130 is coaxially linked to a rotating shaft of the black photosensitive drum 3*a*, and is engaged with the first intermediate gear 112. The first shaft gear 111 provided on a rotating shaft of the first drive unit 110 is engaged with the first intermediate gear 112. Thus, by rotational driving of the first drive unit 110, the black photosensitive drum 3*a* that is linked to the black photosensitive body drive gear 130 can be caused to rotate via the first shaft gear 111, the first intermediate gear 112, and the black photosensitive body drive gear 130.

Also, the cyan photosensitive body drive gear 140*b* is coaxially linked to a rotating shaft of the cyan photosensitive drum 3*b*, and is engaged with the third intermediate gear 123. The magenta photosensitive body drive gear 140*c* is coaxially linked to a rotating shaft of the magenta photosensitive drum 3*c*, and is engaged with the second intermediate gear 122, the third intermediate gear 123, and the fourth intermediate gear 124. The yellow photosensitive body drive gear 140*d* is coaxially linked to a rotating shaft of the yellow photosensitive drum 3*d*, and is engaged with the fourth intermediate gear 124. The second shaft gear 121 provided on a rotating shaft of the second drive unit 120 is engaged with the second intermediate gear 122. Thus, by rotational driving of the second drive unit 120, the magenta photosensitive drum 3*c* that is linked to the magenta photosensitive body drive gear 140*c* can be caused to rotate via the second shaft gear 121, the second intermediate gear 122, and the magenta photosensitive body drive gear 140*c*; the cyan photosensitive drum 3*b* that is linked to the cyan photosensitive body drive gear 140*b* can be caused to rotate via the magenta photosensitive body drive gear 140*c*, the third intermediate gear 123, and the cyan photosensitive body drive gear 140*b*; and the yellow photosensitive drum 3*d* that is linked to the yellow photosensitive body drive gear 140*d* can be caused to rotate via the magenta photosensitive body drive gear 140*c*, the fourth intermediate gear 124, and the yellow photosensitive body drive gear 140*d*.

Thus, the second drive unit 120 for the color photosensitive drums 3*b*, 3*c*, and 3*d* can be a common drive unit. Further, the cyan, magenta, and yellow photosensitive drums 3*b*, 3*c*, and 3*d* rotate in coordination with each other by the common second driving unit 120. In this way, the first drive unit 110 can cause the photosensitive drum 3*a* to rotate independently when performing monochrome printing.

The first drive unit 110 also drives the black development unit 2*a*, and the second drive unit 120 also drives the cyan development unit 2*b*, the magenta development unit 2*c*, and the yellow development unit 2*d*.

Configuration of Phase Detection Sensors

Here, the first phase detection sensor 170*a* is a transmission-type light sensor (photo interrupter) having a light-emitting portion 171*a* and a light-receiving portion 172*a*. The first phase detection sensor 170*a* detects a projection portion or a cut-out portion of a rotation member that rotates due to rotation of the black photosensitive drum 3*a* (here, a cut-out portion 131*a* obtained by cutting out a rib portion 131 of the black photosensitive body drive gear 130). Specifically, the first phase detection sensor 170*a* interrupts incident light to be incident on the light-receiving portion 172*a* from the light-emitting portion 171*a* or allows the incident light to pass through using the projection portion or the cut-out portion 131*a* by the projection portion or the cut-out portion 131*a* revolving following rotation of the black photosensitive body drive gear 130, thereby detecting the presence/absence of incident light at the light-receiving portion 172*a*.

Here, the second phase detection sensor 170*b* is a transmission-type light sensor (photo interrupter) having a light-emitting portion 171*b* and a light-receiving portion 172*b*. The second phase detection sensor 170*b* detects a projection portion or a cut-out portion of a rotation member that rotates due to rotation of the second group photosensitive body 30*b* (here, a cut-out portion 141*a* obtained by cutting out a rib portion 141 of the color photosensitive body drive gear 140 (specifically, the yellow photosensitive body drive gear 140*d*)). Specifically, the second phase detection sensor 170*b* interrupts incident light to be incident on the light-receiving portion 172*b* from the light-emitting portion 171*b* or allows the incident light to pass through using the projection portion or the cut-out portion 141*a* by the projection portion or the cut-out portion 141*a* revolving following rotation of the color photosensitive body drive gear 140, thereby detecting the presence/absence of incident light at the light-receiving portion 172*b*.

Note that the first and second phase detection sensors 170*a* and 170*b* may be reflective-type light sensors.

Configuration of Control System

The color image forming apparatus D is further provided with a control unit 300 that controls the entire color image forming apparatus D.

Figure 4A:
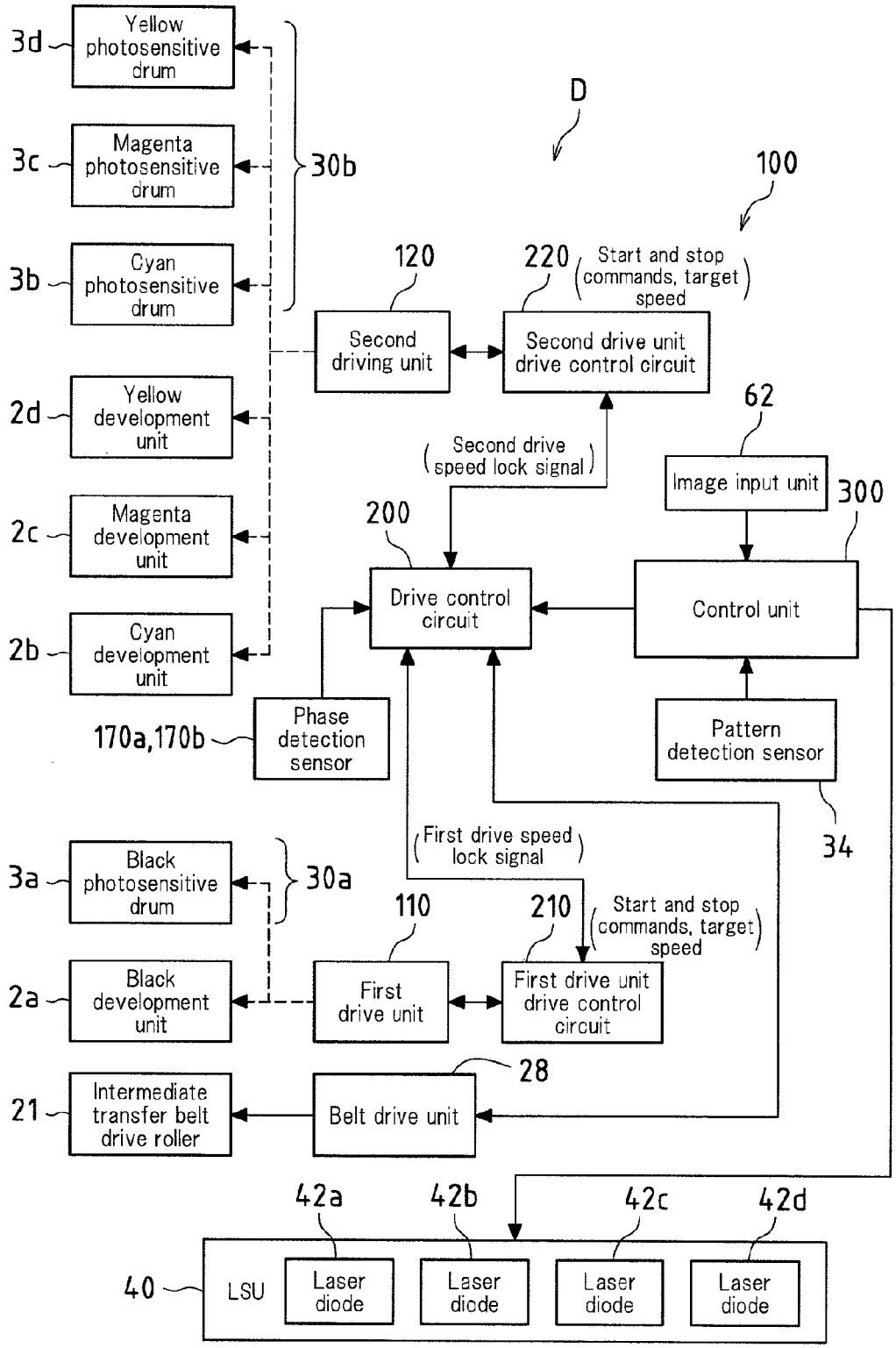
FIG. 4A is a block diagram schematically showing the system configuration of the color image forming apparatus shown in FIG. 1.

FIG. 4A is a block diagram schematically showing the system configuration of the color image forming apparatus D shown in FIG. 1.

The control unit 300 controls drive of the driving load of the driving apparatus 100 shown in FIG. 4A. The driving apparatus 100 is further provided with a drive control circuit 200 that operates as a drive control circuit, a first drive unit drive control circuit 210, a second drive unit drive control circuit 220, and a belt drive unit 28.

As already described, the first drive unit 110 is a motor that drives the black photosensitive drum 3*a* of the first group photosensitive body 30*a* and the black developing unit 2*a*. The second drive unit 120 is a motor that drives the color photosensitive drums 3*b*, 3*c*, and 3*d* of the second group photosensitive body 30*b* and the color development units 2*b*, 2*c*, and 2*d*.

The drive control circuit 200 operationally controls the first drive unit 110 and the second drive unit 120 based on instruction signals from the control unit 300.

The first drive unit drive control circuit 210 is connected between the drive control circuit 200 and the first drive unit 110. The second drive unit drive control circuit 220 is connected between the drive control circuit 200 and the second drive unit 120.

The drive control circuit 200 gives commands to the first drive unit drive control circuit 210 to start and stop the first drive unit 110. The first drive unit drive control circuit 210 is a circuit that controls starting, stopping, and drive speed of the first drive unit 110 according to instructions from the drive control circuit 200 and here, is a servo control circuit that performs control so as to match the drive speed of the first drive unit 110 to a target speed commanded by the drive control circuit 200. The drive control circuit 200 commands the first drive unit drive control circuit 210 to drive the first drive unit 110 at a process speed (drive speed for image forming) determined in advance when performing image forming.

Also, the drive control circuit 200 gives commands to the second drive unit drive control circuit 220 to start and stop the second drive unit 120. The second drive unit drive control circuit 220 is a circuit that controls starting, stopping, and drive speed of the second drive unit 120 according to instructions from the drive control circuit 200 and here, is a servo control circuit that performs control so as to match the drive speed of the second drive unit 120 to a target speed commanded by the drive control circuit 200. The drive control circuit 200 commands the second drive unit drive control circuit 220 to drive the second drive unit 120 at the process speed when performing image forming.

The first drive unit 110 is operationally controlled according to instructions from the drive control circuit 200, and rotationally drives the black photosensitive drum 3*a* at a fixed circumferential speed V. The second drive unit 120 is operationally controlled according to instructions from the drive control circuit 200, and rotationally drives, at the circumferential speed V, the cyan photosensitive drum 3*b*, the magenta photosensitive drum 3*c*, and the yellow photosensitive drum 3*d* that rotate in coordination with each other in the second group photosensitive body 30*b*.

The belt drive unit 28 is a drive motor that drives the intermediate transfer belt driving roller 21. The belt drive unit 28 rotationally drives the intermediate transfer belt 7 via the intermediate transfer belt driving roller 21. The belt drive unit 28 is operationally controlled according to instructions from the drive control circuit 200, and causes the intermediate transfer belt 7 to revolve at the circumferential speed V.

The phase detection sensors 170*a* and 170*b* are connected to the input system of the drive control circuit 200.

The first phase detection sensor 170*a* detects the rotation timing of the black photosensitive drum 3*a*. The second phase detection sensor 170*b* detects the rotation timing of the second group photosensitive body 30*b*.

Furthermore, the control unit 300 also controls operation of units that serve as constituent units of the color image forming apparatus D and are not shown in the diagrams.

An image input unit 62 and the pattern detection sensor 34 are connected to the input system of the control unit 300, and an LSU 40 is connected to the output system thereof.

The image input unit 62 obtains image data of an image to be output from outside. A source that provides image data is a device connected to the color image forming apparatus D via a communication line. An example of this device is a host such as a personal computer. Another example is an image scanner. The obtained image data is stored in a RAM of a storage means 320 (see FIG. 4B) described later, for print processing. Image data obtained from the image input unit 62 is given information indicating attributes thereof. The given attributes include the length and width of the corresponding image and the type thereof, that is, whether the image is a monochrome image or a color image.

The LSU 40 is provided with a black laser diode 42*a*, a cyan laser diode 42*b*, a magenta laser diode 42*c*, and a yellow laser diode 42*d*.

The LSU 40 receives signals (pixel signals) based on image data stored in an image memory area in the RAM of the storage means 320, from an image processing unit (not shown). The image processing unit processes image data, and provides the LSU 40 with modulating signals according to the pixels of the image to be output.

Note that modulating signals are provided according to each of black, cyan, magenta, and yellow color components. The black, cyan, magenta, and yellow modulating signals are used in order to respectively modulate light emitted by the laser diodes 42*a*, 42*b*, 42*c*, and 42*d* in the LSU 40.

In the case where an electrostatic latent image is formed on each of the black, cyan, magenta, and yellow photosensitive drums 3*a* to 3*d*, the control unit 300 causes each of the black laser diode 42*a*, and the cyan laser diode 42*b*, the magenta laser diode 42*c*, and the yellow laser diode 42*d* serving as color laser diodes to emit light, and controls the diodes to respectively expose the black, cyan, magenta, and yellow photosensitive drums 3*a* to 3*d* that are uniformly charged.

Further, the control unit 300 compares detection timings of the patterns Pa to Pd (see FIG. 5) read by the pattern detection sensor 34 with normal timings, thereby obtaining deviations. The deviation of timings can be converted into a positional deviation using the circumferential speed V of the intermediate transfer belt 7. This timing deviation will be described later in detail.

Figure 4B:
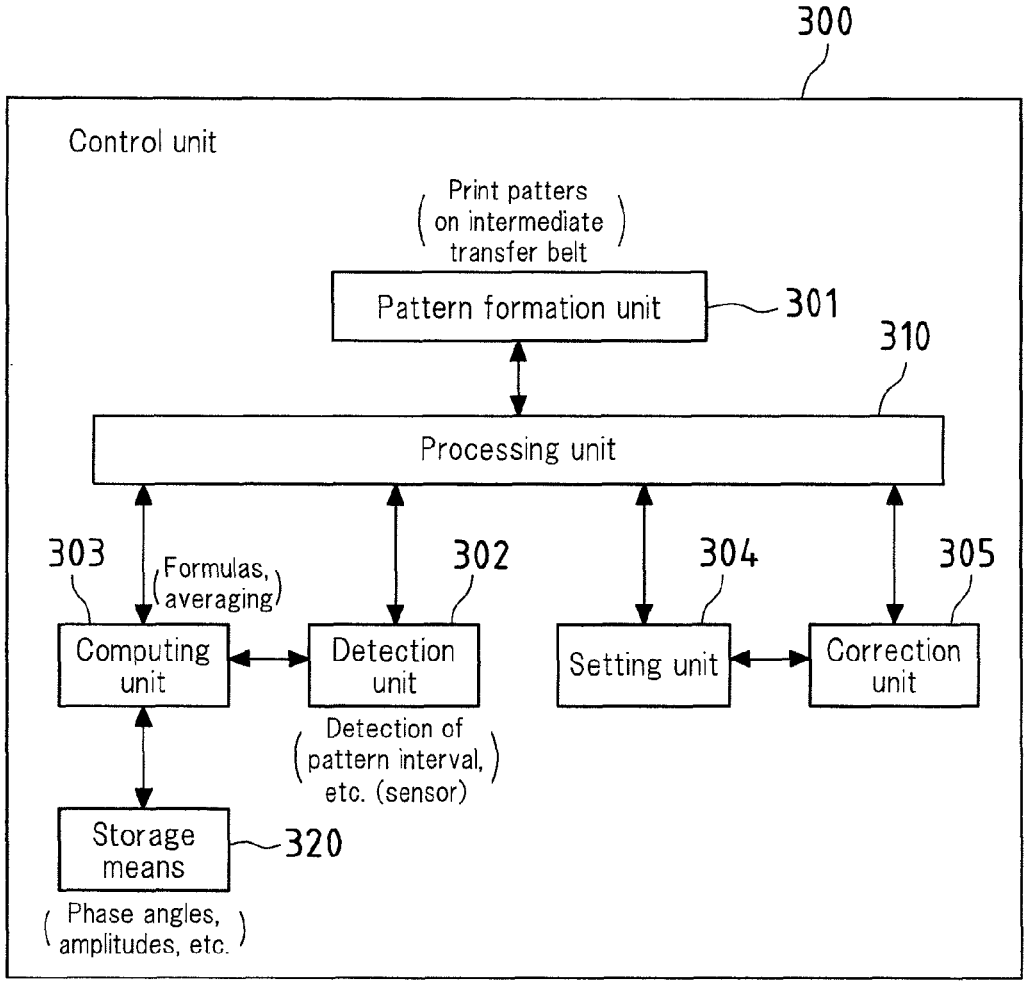
FIG. 4B is a block diagram showing in detail a control unit shown in FIG. 4A.

FIG. 4B is a block diagram showing in detail the control unit 300 shown in FIG. 4A. As shown in FIG. 4B, the control unit 300 includes a processing unit 310 constituted by a microcomputer such as a CPU (central processing unit), and the storage means 320 including storage apparatuses such as a ROM (read only memory), a RAM (random access memory), and a data rewritable nonvolatile memory.

The control unit 300 operationally controls various constituent elements by the processing unit 310 loading a control program stored in the ROM of the storage means 320 in advance in the RAM of the storage means 320 and executing the program. The RAM of the storage means 320 provides the control unit 300 with an area as a work area for working and an image memory that stores image data.

Specifically, the control unit 300 stores obtained image data in the RAM in association with the given attributes. Image data is stored in the RAM in job units and furthermore, is stored in page units if one job includes a plurality of pages. If image data is input in the form of a page description language from an external host, the control unit 300 expands the input image data, and stores the data in the image memory area. The ROM of the storage means 320 stores a program in which the processing procedure executed by the control unit 300 is determined.

The storage means 320 stores various data and computing equations used by a pattern formation unit 301, a detection unit 302, a computing unit 303, a setting unit 304, and a correction unit 305, which are described later.

Correction of Relative Phase Shift

The color image forming apparatus D is configured such that the cyan photosensitive drum 3*b*, the magenta photosensitive drum 3*c*, and the yellow photosensitive drum 3*d* rotate in coordination with each other. Thus, if position displacement in the circumferential direction occurs due to a periodic variation (hereinafter, referred to as rotational irregularity) in the circumferential speed V resulting from eccentricity of the black photosensitive drum 3*a*, eccentricity of each of the cyan photosensitive drum 3*b*, the magenta photosensitive drum 3*c*, and the yellow photosensitive drum 3*d*, eccentricity of the drive transmission rotation member such as the drive gear that transmits rotational drive from the first drive unit 110 to the black photosensitive drum 3*a*, eccentricity of each drive transmission rotation member such as the drive gears that transmit rotational drive from the second drive unit 120 to the cyan photosensitive drum 3*b*, the magenta photosensitive drum 3*c*, and the yellow photosensitive drum 3*d*, or the like, since the cyan photosensitive drum 3*b*, the magenta photosensitive drum 3*c*, and the yellow photosensitive drum 3*d* in the second group photosensitive body 30*b* rotate in coordination with each other, a relative phase shift due to rotational irregularity cannot be adjusted for each other between the cyan, magenta, and yellow photosensitive drums 3*b* to 3*d*. Moreover, a relative phase shift due to rotational irregularity also cannot be separately adjusted between the black photosensitive drum 3*a* and each of the cyan, magenta, and yellow photosensitive drums 3*b* to 3*d*.

Thus, the color image forming apparatus D according to the present embodiment is provided with the following control configuration in order to optimally correct a relative phase shift between rotational irregularity of the black photosensitive drum 3*a* and rotational irregularity of the second group photosensitive body 30*b* (rotational irregularity of the cyan, magenta, and yellow photosensitive drums 3*b* to 3*d* that cannot be adjusted for each other).

Specifically, the control unit 300 is configured so as to function as the pattern formation unit 301, the detection unit 302, the computing unit 303, the setting unit 304, and the correction unit 305.

Pattern Formation Unit

Figure 5:
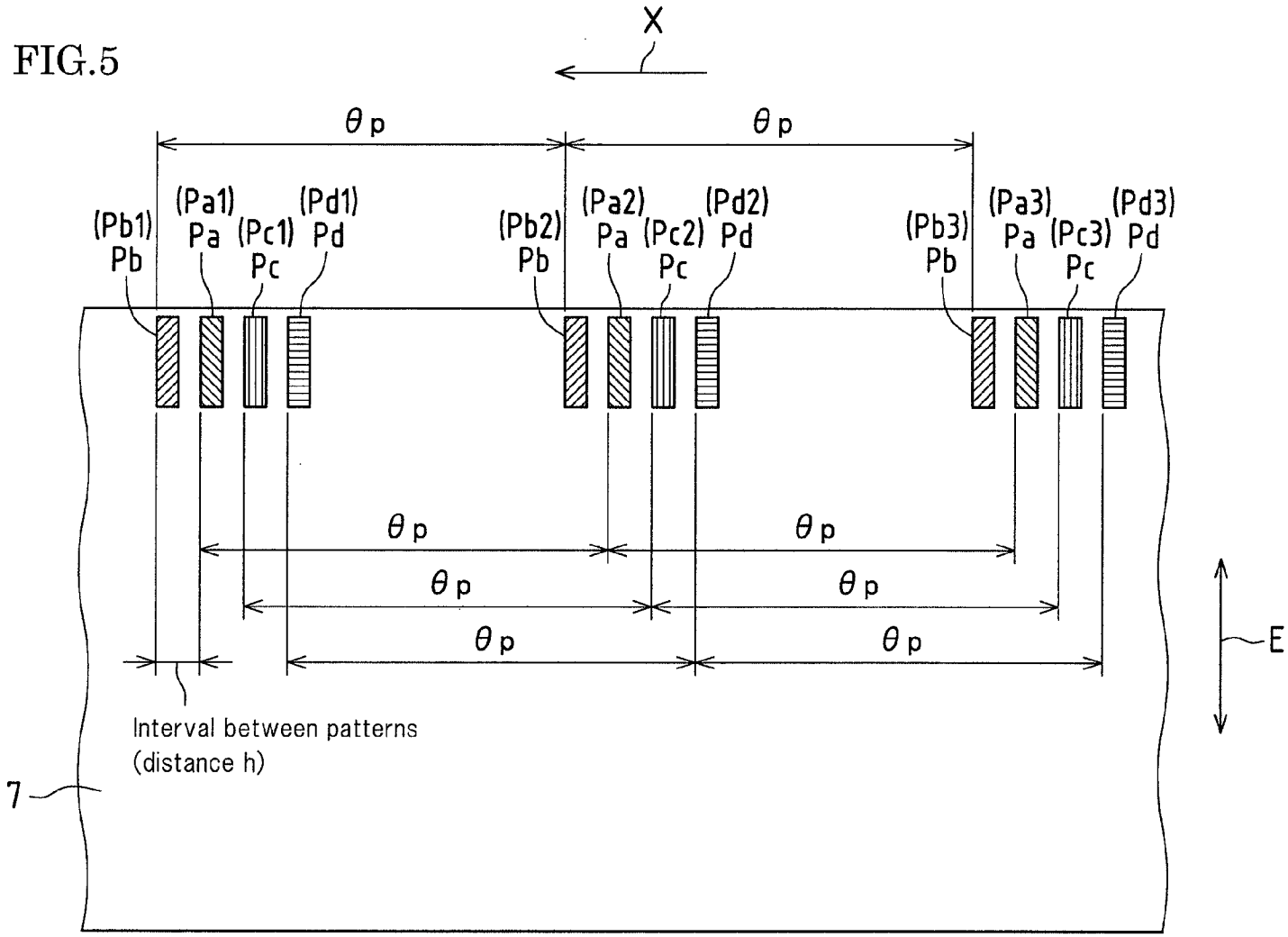
FIG. 5 is a plan view showing an example in which a black reference pattern, a cyan detection pattern, a magenta detection pattern, and a yellow detection pattern are formed on an intermediate transfer belt.

FIG. 5 is a plan view showing an example in which the black reference pattern Pa (Pa1, Pa2, and Pa3 in the example in the diagram), the cyan detection pattern Pb (Pb1, Pb2, and Pb3 in the example in the diagram), the magenta detection pattern Pc (Pc1, Pc2, and Pc3 in the example in the diagram), and the yellow detection pattern Pd (Pd1, Pd2, and Pd3 in the example in the diagram) are formed on the intermediate transfer belt 7.

In the present embodiment, the pattern formation unit 301 forms the black reference pattern Pa, which is a black image, as a reference pattern for a reference color, and forms the cyan detection pattern Pb, the magenta detection pattern Pc, and the yellow detection pattern Pd, which are color images, as detection patterns for detection colors.

Specifically, the pattern formation unit 301 forms the black reference pattern Pa formed using the black photosensitive drum 3*a*, on the intermediate transfer belt 7 (an example of a recording medium) at a predetermined constant pitch in the circumferential direction (here, rotation angle $\theta p=120°$).

Also, the pattern formation unit 301 forms the cyan detection pattern Pb, the magenta detection pattern Pc, and the yellow detection pattern Pd respectively formed using the cyan, magenta, and yellow photosensitive drums 3*b* to 3*d*, on the intermediate transfer belt 7 at the same pitch as that for the black reference pattern Pa (here, rotation angle $\theta p=120°$).

Specifically, the pattern formation unit 301 forms electrostatic latent images corresponding to the patterns Pa to Pd on the black, cyan, magenta, and yellow photosensitive drums 3*a* to 3*d* using the LSU 40, develops the formed electrostatic latent images into toner images using the development apparatuses (here, development units) 2*a* to 2*d*, and electrostatically transfers the developed toner images as the patterns Pa to Pd to the intermediate transfer belt 7 using the transfer units (here, intermediate transfer rollers) 6*a* to 6*d*. Note that in the present embodiment, although the color of the reference pattern is black, any of the other colors, that is, yellow, magenta, and cyan, may be used as the color of the reference pattern.

Specifically, the pattern formation unit 301 obtains pattern data of the patterns Pa to Pd stored in the storage means 320 in advance when forming the patterns Pa to Pd. The pattern formation unit 301 expands the obtained pattern data in the image memory area, and prepares the patterns Pa to Pd. After that, the pattern formation unit 301 transfers the expanded data of the patterns Pa to Pd to the LSU 40.

Then, in the LSU 40, the laser diodes 42*a* to 42*d* that have received the data respectively form electrostatic latent images corresponding to the patterns Pa to Pd on the photosensitive drums 3*a* to 3*d*.

The development units 2*a* to 2*d* develop the electrostatic latent images formed by the LSU 40, and form toner images of the patterns Pa to Pd. The toner images of the patterns Pa to Pd are respectively transferred on the intermediate transfer belt 7 by the intermediate transfer rollers 6*a* to 6*d*. In this way, the black reference pattern Pa, the cyan detection pattern Pb, the magenta detection pattern Pc, and the yellow detection pattern Pd are formed on the intermediate transfer belt 7.

The patterns Pa to Pd are formed on the intermediate transfer belt 7, into a straight shape extending in a width direction (main scanning direction) E of the intermediate transfer belt 7 so as to be arranged and align in the movement direction X.

From the downstream side in the movement direction X of the intermediate transfer belt 7 toward the upstream side, the patterns are formed in the same order, specifically, here the cyan detection patterns Pb1, Pb2, and Pb3, the black reference patterns Pa1, Pa2, and Pa3, the magenta detection patterns Pct, Pc2, and Pc3, and the yellow detection patterns Pd1, Pd2, and Pd3 are formed in this stated order. Note that the patterns Pa to Pd may be detected at a plurality of locations in the width direction E of the intermediate transfer belt 7. For example, the patterns Pa to Pd may be formed on an edge portion in the width direction E of the intermediate transfer belt 7, or may be formed on both edge portions.

Figure 6:
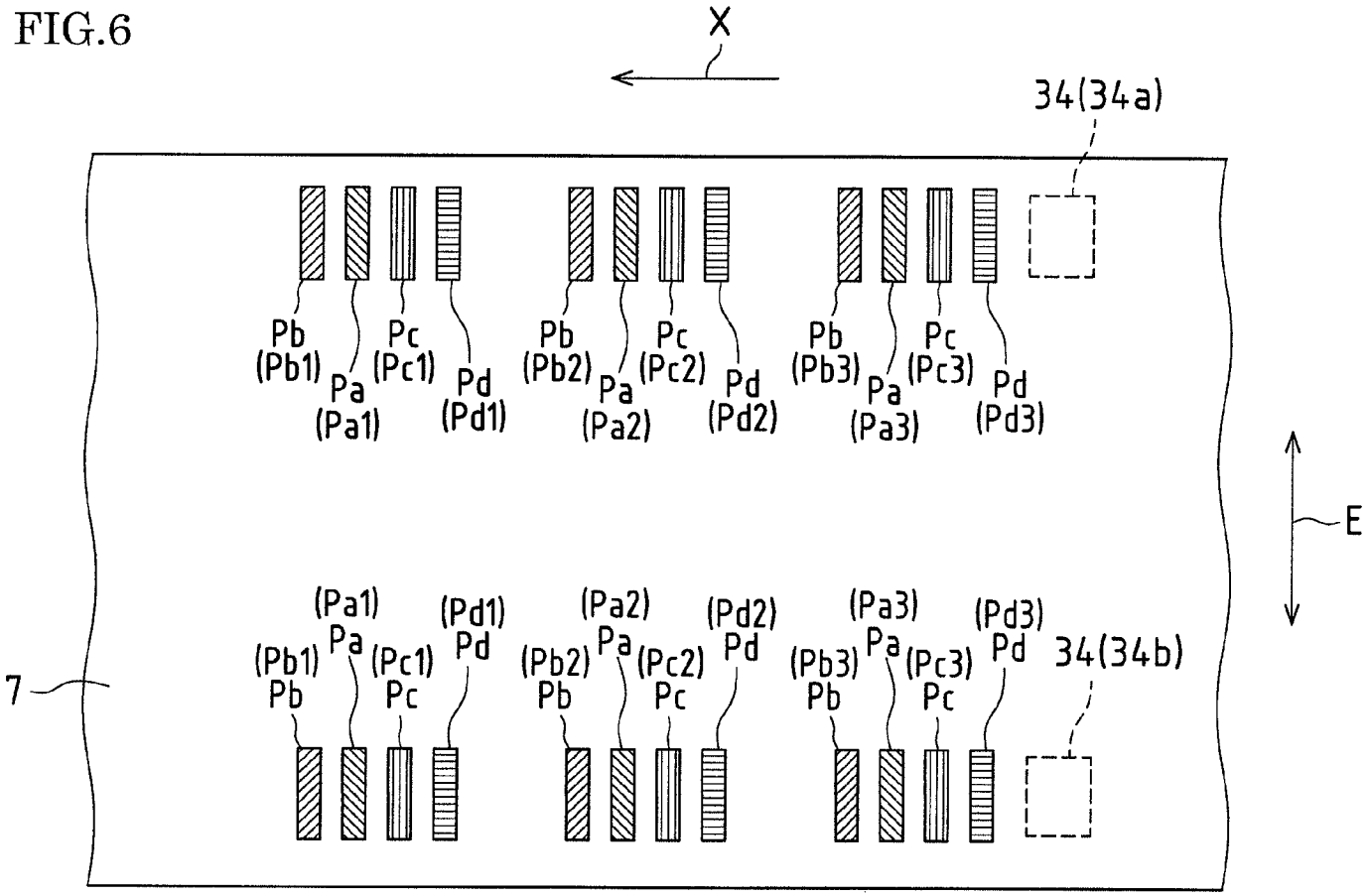
FIG. 6 is a plan view showing a positional relationship between pattern detection sensors and the patterns formed on both edge portions in the width direction of the intermediate transfer belt on the intermediate transfer belt.

FIG. 6 is a plan view showing a positional relationship between the patterns Pa to Pd formed on both edge portions in the width direction E of the intermediate transfer belt 7 and the pattern detection sensors 34 (first and second pattern detection sensors 34*a* and 34*b* in the example in the diagram) on the intermediate transfer belt 7.

The pattern detection sensors 34 are provided corresponding to the patterns Pa to Pd that are formed at different positions in the width direction (main scanning direction) E of the intermediate transfer belt 7. In the example shown in FIG. 6, the pattern detection sensors 34 are constituted by the first and second pattern detection sensors 34*a* and 34*b*. The pattern detection sensors are disposed in opposition to each other at positions where the patterns Pa to Pd are to be formed in a plurality of locations in the width direction E on the intermediate transfer belt 7. Note that if the patterns Pa to Pd are detected at a plurality of locations in the width direction E of the intermediate transfer belt 7, the average values of the values detected at the plurality of locations can be used as the values of the patterns.

Each of the patterns Pa to Pd formed on the intermediate transfer belt 7 includes a pitch variation component due to a periodic variation in the circumferential speed V of the corresponding photosensitive drums 3*a* to 3*d*. If the pitch variations do not match, this state will be recognized as color misalignment of the images.

Figure 7:
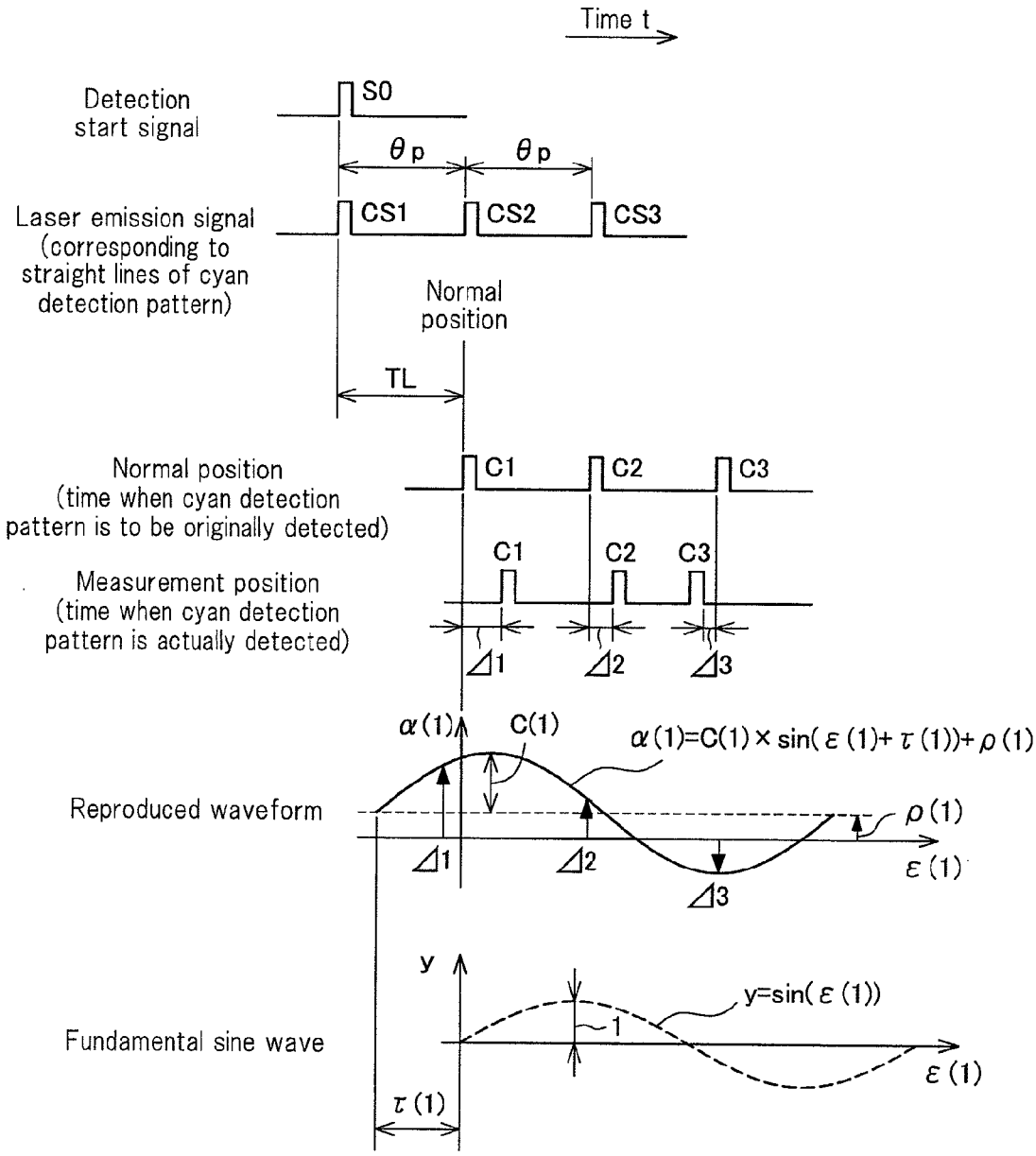
FIG. 7 is a timing chart showing timings of signals for forming, on a cyan photosensitive drum, the cyan detection pattern among the patterns.

FIG. 7 is a timing chart showing timings of signals for forming, on the cyan photosensitive drum 3*b*, the cyan detection pattern Pb (Pb1, Pb2, and Pb3) among the patterns Pa to Pd. Note that in the diagram, reference numeral S0 denotes a detection start signal that is output from the control unit 300 at an arbitrary time, and used as the start reference in pattern detection processing.

Although both a rotation angle and distance are in the following description, both of them are converted into time and interpreted.

Laser emission signals CS1, CS2, and CS3 are output from the cyan laser diode 42*b* to the cyan photosensitive drum 3*b* at every rotation angle θp (here, 120°) using the detection start signal S0 as a reference. The laser emission signals CS1, CS2, and CS3 are signals for respectively forming the cyan detection pattern Pb (Pb1, Pb2, and Pb3) in the form of strips (see FIGS. 5 and 6).

The time when the detection signals C1, C2, and C3 are detected at normal positions that are positioned after a delay time TL from the detection start signal S0 is the time when the cyan detection pattern Pb (Pb1, Pb2, and Pb3) respectively formed according to the laser emission signals CS1, CS2, and CS3 are to be originally detected with no rotational irregularity. Here, the delay time TL corresponds to a total time of a time period necessary for the cyan photosensitive drum 3*b* to rotate from an exposure position to laser beam from the cyan laser diode 42*b* in the LSU 40 to a transfer position and a time period necessary for the intermediate transfer belt 7 to move from the transfer position for a cyan image to the pattern detection sensors 34.

The time when the detection signals C1, C2, and C3 are detected at measurement positions with respect to the normal positions is the time when the cyan detection pattern Pb (Pb1, Pb2, and Pb3) respectively formed according to the laser emission signals CS1, CS2, and CS3 is actually detected with rotational irregularity. The shifts from the detection signals C1, C2, and C3 at the normal positions are represented by Δ1, Δ2, and Δ3.

Note that a reproduced waveform can be a cyan detection compressional wave, which can be calculated based on Δ1, Δ2, and Δ3 using, for example, the sine curve-fitting formula described later, and represented by the following equation:

$$\text{the cyan detection compressional wave } \alpha(1)=C(1)\times\sin(\epsilon(1)+\tau(1))+\rho(1)$$

Here, a compressional wave is a wave representing a periodic change in the amount of position displacement indicating position displacement in the circumferential direction due to rotational irregularity in each of the patterns Pa to Pd. C(1) in the equation represents the amplitude of the compressional wave, ϵ(1) represents an angle of the compressional wave, τ(1) represents a phase angle of the compressional wave, and ρ(1) represents a shift value in the sub-scanning direction of the compressional wave.

A fundamental sine wave is a fundamental waveform for the cyan detection compressional wave α(1), and represented by the following equation:

$$y=\sin(\epsilon(1))$$

In this case, the normal position corresponds to the following equation:

$$\epsilon(1)=0$$

The same also applies to a black reference compressional wave αa, a magenta detection compressional wave α(2), and a yellow detection compressional wave α(3), which will be described later.

Figure 8:
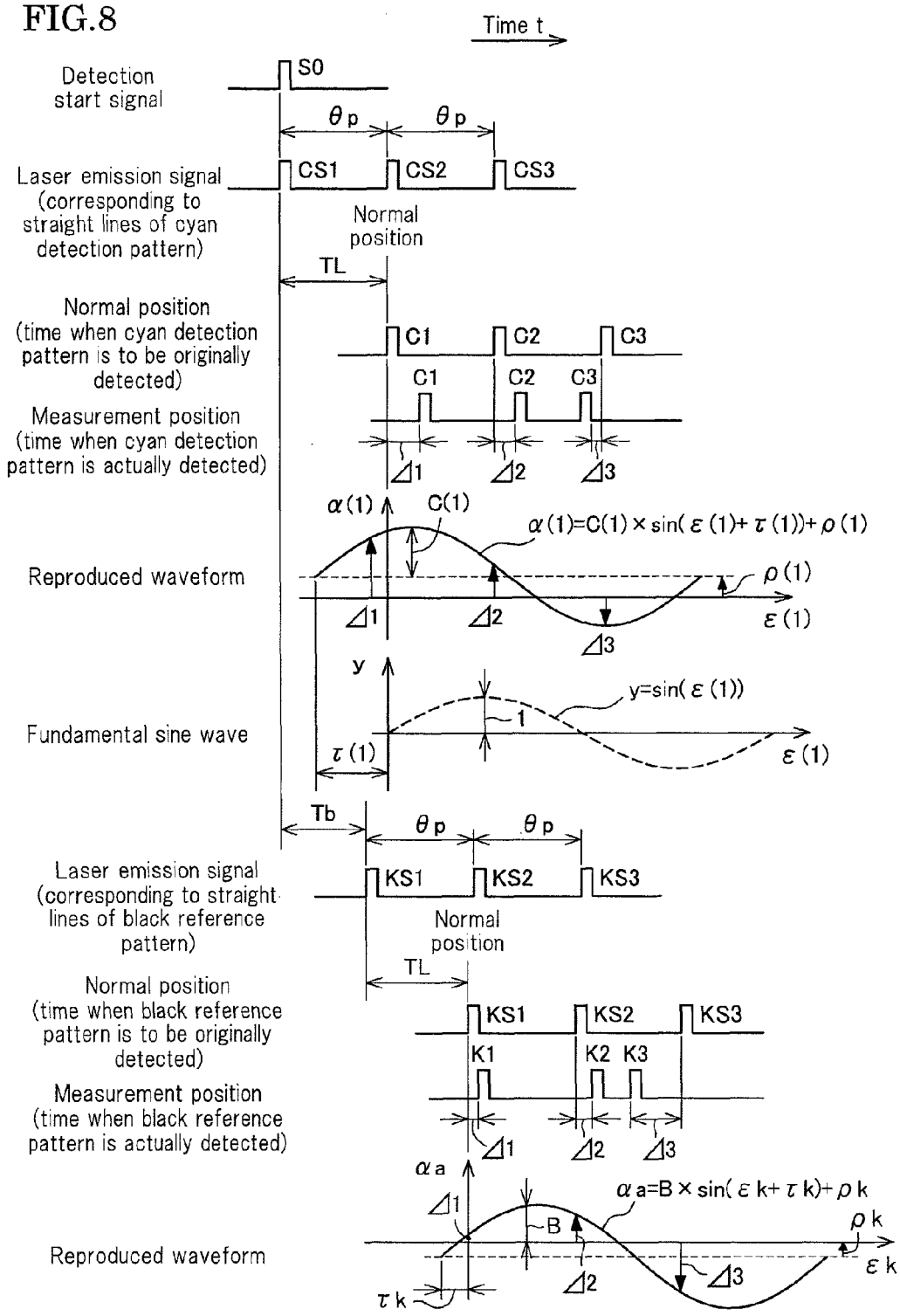
FIG. 8 is a timing chart showing formation timings for the cyan detection pattern and the black reference pattern.

FIG. 8 is a timing chart showing formation timings for the cyan detection pattern Pb and the black reference pattern Pa. Note that in FIG. 8, the timing chart for the cyan photosensitive drum 3*b* is the same as that shown in FIG. 7.

In the present embodiment, the patterns of different colors are formed at different positions in the movement direction (sub-scanning direction) X of the intermediate transfer belt 7, and an interval (distance h, for example, about 3 mm, see FIG. 5) is given between the patterns.

Accordingly, as shown in FIG. 8, laser emission signals KS1, KS2, and KS3 are output from the black laser diode 42*a* to the black photosensitive drum 3*a* at every rotation angle θp (here, 120°), using the time that is delayed for a delay time Tb from the detection start signal S0 as a reference. Also, the laser emission signals KS1, KS2, and KS3 are signals for respectively forming the black reference pattern Pa (Pa1, Pa2, and Pa3) in the form of strips (see FIGS. 5 and 6), as with the case of cyan. Here, the delay time Tb is a time obtained by dividing a value that has been obtained by subtracting the interval (distance h, for example, 3 mm) between adjoining patterns of different colors from a distance Q1 (see FIG. 1) between the black photosensitive drum 3*a* and the cyan photosensitive drum 3*b* by the circumferential speed V. The distance Q1 between the black photosensitive drum 3*a* and the cyan photosensitive drum 3*b*, a distance Q2 between the cyan photosensitive drum 3*b* and the magenta photosensitive drum 3*c*, and a distance Q3 between the magenta photosensitive drum 3*c* and the yellow photosensitive drum 3*d* are all the same here, and can be about 100 mm, for example. Further, the diameter of the photosensitive drums 3*a* to 3*d* is also the same here, and can be about 30 mm, for example.

The time when the detection signals K1, K2, and K3 are detected at the normal positions that are positioned after a delay time (Tb+TL) from the detection start signal S0 is the time when the black reference pattern Pa (Pa1, Pa2, and Pa3) respectively formed according to the laser emission signals KS1, KS2, and KS3 is to be originally detected with no rotational irregularity. Here, the delay time TL corresponds to a total time (see FIG. 1) of a time period necessary for the black photosensitive drum 3*a* to rotate from an exposure position to laser beam from the black laser diode 42*a* in the LSU 40 to a transfer position and a time period necessary for the intermediate transfer belt 7 to move from the transfer position for a black image to the pattern detection sensors 34.

The time when the detection signals K1, K2, and K3 are detected at measurement positions with respect to the normal positions is the time when the black reference pattern Pa (Pa1, Pa2, and Pa3) respectively formed according to the laser emission signals KS1, KS2, and KS3 is actually detected with rotational irregularity. The shifts from the detection signals K1, K2, and K3 at the normal positions are represented by Δ1, Δ2, and Δ3.

Further, in the case where a value when the interval between adjoining patterns of different colors (distance h) is converted into a rotation angle is ψ, if, for example, the diameter of the photosensitive drums is 30 mm when the interval (distance h) between adjoining patterns is 3 mm, the rotation angle ψ is about 11.5°. That is, printing of the cyan detection pattern Pb (Pb1, Pb2, and Pb3) is started at a time earlier by the delay time Tb corresponding to the rotation angle ψ, so that the black reference pattern Pa (Pa1, Pa2, and Pa3) and the cyan detection pattern Pb (Pb1, Pb2, and Pb3) do not overlap.

Note that a reproduced waveform can be a black reference compressional wave, which can be calculated, as with the case of the cyan detection compressional wave α(1), based on Δ1, Δ2, and Δ3 using the sine curve-fitting formula described later, and represented by the following equation:

$$\text{the black reference compressional wave } \alpha a=B\times\sin(\epsilon k+\tau k)+\rho k$$

The same description as that for the case of the cyan detection compressional wave α(1) and the black reference compressional wave αa is also applicable to the magenta detection compressional wave α(2) corresponding to the magenta detection pattern Pc (Pc1, Pc2, and Pc3) and the yellow detection compressional wave α(3) corresponding to the yellow detection pattern Pd (Pd1, Pd2, and Pd3).

Specifically, the magenta detection compressional wave α(2) and the yellow detection compressional wave α(3) can also be obtained by the sine curve-fitting formula described later, and can be respectively represented by the following equations:

the magenta detection compressional wave $\alpha(2)=C(2)\times\sin(\epsilon(2)+\tau(2))+\rho(2)$; and the yellow detection compressional wave $\alpha(3)=C(3)\times\sin(\epsilon(3)+\tau(3))+\rho(3)$ Here, variables ρk, ρ(1), ρ(2), and ρ(3) are shift values in the sub-scanning direction, and it can be considered that the main cause thereof is thermal expansion of the scanning optical system 43 such as a polygon mirror in the LSU 40. It is possible to adjust this factor by changing the timing of starting to print sub scanning lines of each color.

Detection Unit

The detection unit 302 detects an amplitude B of the black reference compressional wave αa. Further, the detection unit 302 detects an amplitude C(i) (i is an integer of one or more and m or less) of each of the m (m is an integer of two or more, here, three) cyan, magenta, and yellow detection compressional waves α(i). Moreover, the detection unit 302 detects a relative phase angle ϕ(i) of each of the m (here, three) cyan, magenta, and yellow detection compressional waves α(i) relative to the black reference compressional wave αa.

In the present embodiment, the detection unit 302 detects the black reference compressional wave αa, the cyan detection compressional wave α(1), the magenta detection compressional wave α(2), and the yellow detection compressional wave α(3), using Equations (1) to (4) below.

$$\alpha a=B\times\sin(\epsilon k+\tau k)+\rho k \quad \text{Equation (1)}$$

$$\alpha(1)=C(1)\times\sin(\epsilon(1)+\tau(1))+\rho(1) \quad \text{Equation (2)}$$

$$\alpha(2)=C(2)\times\sin(\epsilon(2)+\tau(2))+\rho(2) \quad \text{Equation (3)}$$

$$\circ(3)=C(3)\times\sin(\epsilon(3)+\tau(3))+\rho(3) \quad \text{Equation (4)}$$

These compressional waves αa, α(1), α(2), and α(3) can be obtained by the sine curve-fitting formula disclosed in the invention (JP 2009-251109A) that the applicant of the present invention previously submitted.

Sine Curve-Fitting Formula

Figure 9:
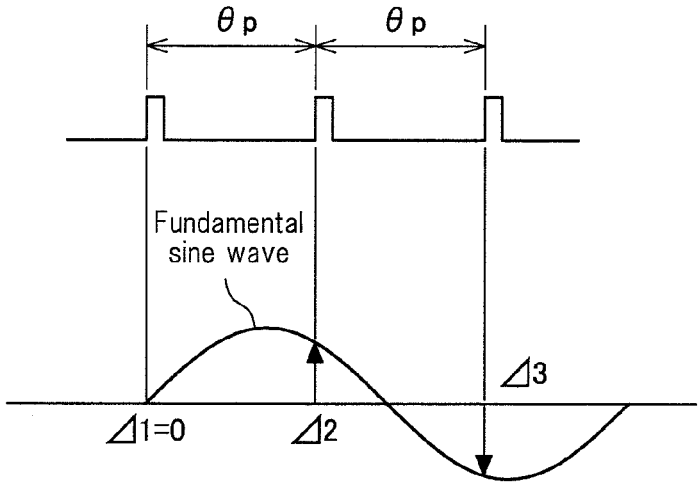
FIG. 9 is a timing chart showing positions where the sum total of a fundamental sine wave at sampling points of the patterns is 0.

FIG. 9 is a timing chart showing positions where the sum total of the fundamental sine wave at sampling points of the patterns Pa to Pd is 0.

The patterns Pa to Pd are each created at S points (S is an integer of two or more and here, three points, 0°, 120°, and 240°) for every rotation angle θp (here, 120°) of the photosensitive drums 3*a* to 3*d*, on the photosensitive drums 3*a* to 3*d*. It is possible to adjust the number of points at which the patterns Pa to Pd are created and the distance between the patterns based on this rotation angle θp. Note that if sine curve-fitting calculus is used, it is preferable that the number of points at which the patterns Pa to Pd are created and the distance between the patterns are minimal (for example, three). Note that although the number of points at which the patterns are created is three in the present embodiment, the number of points may be four or more. That is, the patterns may be each created at S points (for example, four points, 0°, 90°, 180°, and 270°) for every rotation angle θp (for example, 90°) of the photosensitive drums 3*a* to 3*d*, on the photosensitive drums 3*a* to 3*d*.

Here, the sum total of the fundamental sine wave at sampling points being 0 means the total of deviations (Δ1, Δ2, and Δ3) in the fundamental sine wave at respective three sampling points being 0 in the example in FIG. 9.

In FIG. 9, the deviation at the rotation angle 0° is 0, and the deviation at the rotation angle 120° and the deviation at the rotation angle 240° have the relationship as follows:

$$\Delta 2=-\Delta 3$$

Thus, the sum total thereof is as follows:

$$\Delta 1+\Delta 2+\Delta 3=0$$

By performing sampling under such conditions, the shift values ρk, ρ(1), ρ(2), and ρ(3) in the sub-scanning direction described above can be advantageously obtained from the average value of deviations Δs (s is an integer of one or more and S or less).

Phase differences and amplitudes can be obtained taking a short time and using the minimal number of points at which the patterns are created by applying the following sine curve-fitting calculus.

The cyan detection compressional wave α(1) shown in FIGS. 7 and 8 is expressed by Equation (5) below. Here, Equation (2) described above is also shown.

$$\alpha(1)=a\times\sin(\epsilon(1))+b\times\cos(\epsilon(1))+\rho(1) \quad \text{Equation (5)}$$

$$\alpha(1)=C(1)\times\sin(\epsilon(1)+\tau(1))+\rho(1) \quad \text{Equation (2)}$$

The amplitudes a and b of Equation (5), the amplitude C(1) and the phase angle τ(1) of Equation (2), and the shift value ρ(1) in the sub-scanning direction are obtained using Equations (6) to (10) below based on the deviations Δs (here, Δ1, Δ2, and Δ3) of the cyan detection pattern Pb and the angles ϵs(1) (here, ϵ1(1)=0°, ϵ2(1)=120°, ϵ3(1)=240°).

Note that Δs may be a value (Δt) detected as a time difference relative to the normal position or a distance ΔL converted by multiplying Δt by the circumferential speed V. Further, Δs may also be the number of dots ΔD converted by dividing the distance ΔL by the size of one dot (for example, 600 dpi=about 42 μm). If calculation is performed with values converted into the number of dots ΔD, the amplitude and color misalignment indicated by calculation values are calculated in the number of dots, and thus it is advantageous that comparison with a calculation result is easy when a test pattern is printed out and visually checked.

The amplitudes a and b of Equation (5) and the shift value ρ(1) in the sub-scanning direction can be expressed by Equations (6) to (8) below.

[Formulas 1]

$$a=\frac{\sum_S(\sin(\varepsilon s(1))\times\Delta s)}{\sum_S\sin(\varepsilon s(1))^2} \quad \text{Equation (6)}$$

$$b=\frac{\sum_S(\cos(\varepsilon s(1))\times\Delta s)}{\sum_S\cos(\varepsilon s(1))^2} \quad \text{Equation (7)}$$

$$\rho(1)=\frac{\sum_S(\Delta s)}{S} \quad \text{Equation (8)}$$

Figure 10:
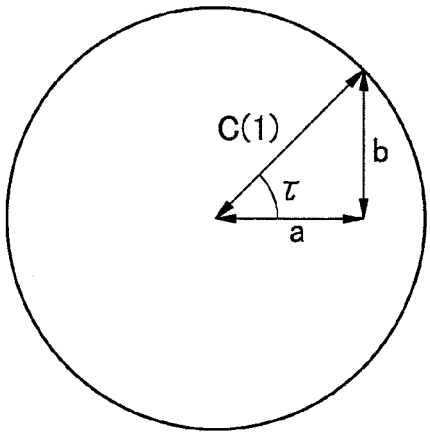
FIG. 10 is a conceptual diagram showing the amplitude of a cyan detection compressional wave.

FIG. 10 is a conceptual diagram showing the amplitude C(1) of the cyan detection compressional wave α(1). The amplitude C(1) can be expressed by Equation (9) below as shown in FIG. 10.

[Formula 2]

$$C(1)=\sqrt{a^2+b^2} \quad \text{Equation (9)}$$

The phase angle $\tau(1)$ can be obtained by converting $\tau$ obtained by Equation (10) below by the transformations in Table 1.

$$\tau=\arcsin(b/C(1)) \quad \text{Equation (10)}$$

TABLE 1

TB

| Quadrant | a | b | Transformation |
|---|---|---|---|
| I | + | + | $\tau(1)=\tau$ |
| II | + | − | $\tau(1)=\tau+360°$ |
| III | − | + | $\tau(1)=-\tau+180°$ |
| IV | − | − | |

Figure 11:
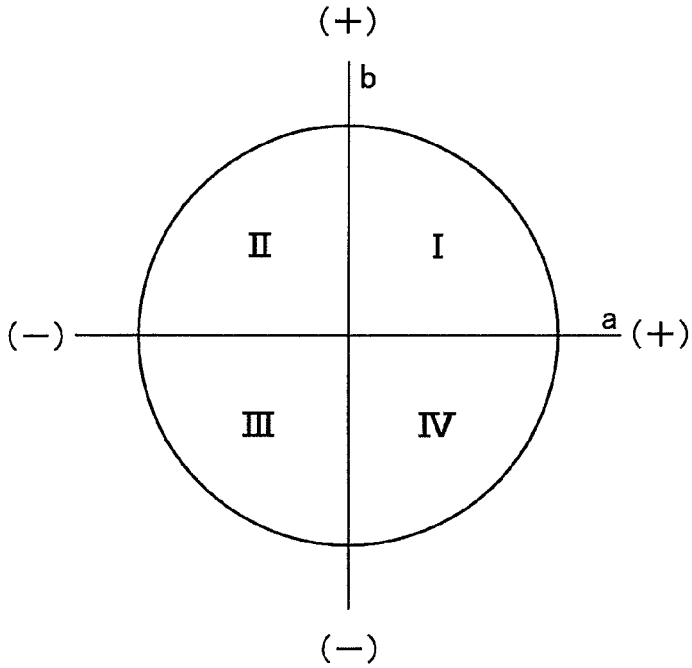
FIG. 11 is an explanatory diagram for describing quadrant I to quadrant IV when the phase difference of the cyan detection compressional wave is obtained.

This is because it is necessary to convert the amplitudes a and b corresponding to quadrant I to quadrant IV shown in FIG. 11. Further, the numerical value range of $\tau(1)$ in the results of calculation by the transformations is represented as follows:

$$0\leqq\tau(1)<360$$

Equations (1) to (10) and table data TB in Table 1 are stored in the storage means 320 in advance.

Figure 12:
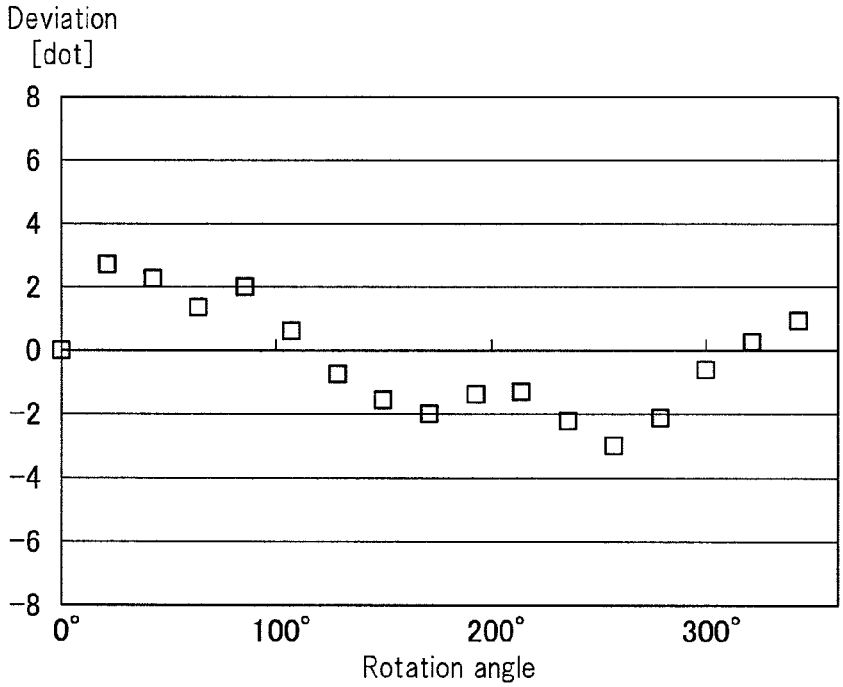
FIG. 12 is a graph showing the result of having created the cyan detection pattern by 17 points at the rotation angle of 360° of the cyan photosensitive drum, and having actually measured deviations.

FIG. 12 is a graph showing the result of having created the cyan detection pattern Pb by 17 points including 3 points, namely, 0°, 120°, and 240°, at the rotation angle of 360° of the cyan photosensitive drum 3*b*, and having actually measured deviations $\Delta 1$ to $\Delta 17$.

Figure 13:
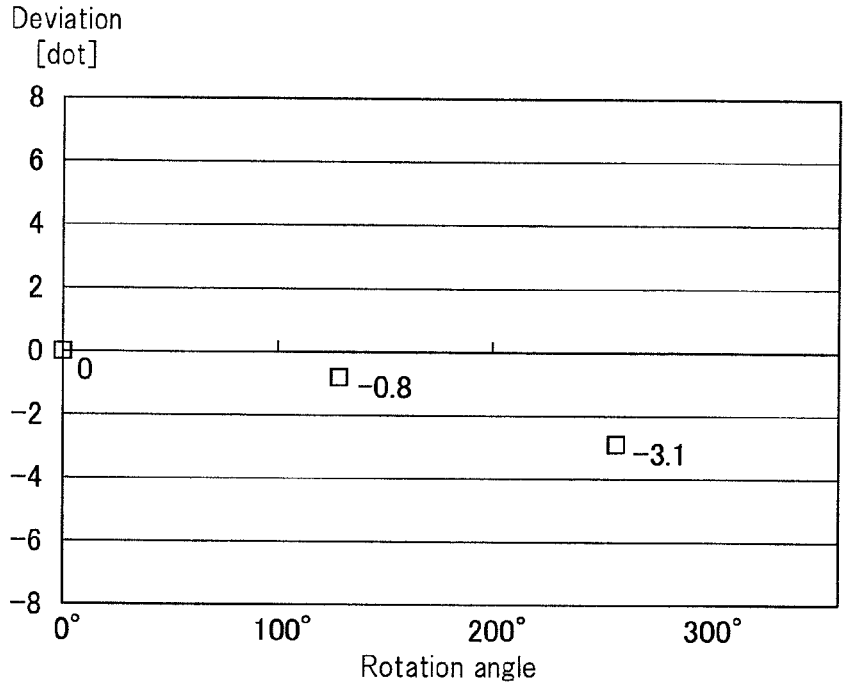
FIG. 13 is a graph showing extracted deviations at 3 points among the 17 points shown in FIG. 12.

FIG. 13 is a graph showing extracted deviations (0, −0.8, −3.1) at 3 points, namely, 0°, 120°, 240° among the 17 points shown in FIG. 12.

Figure 14:
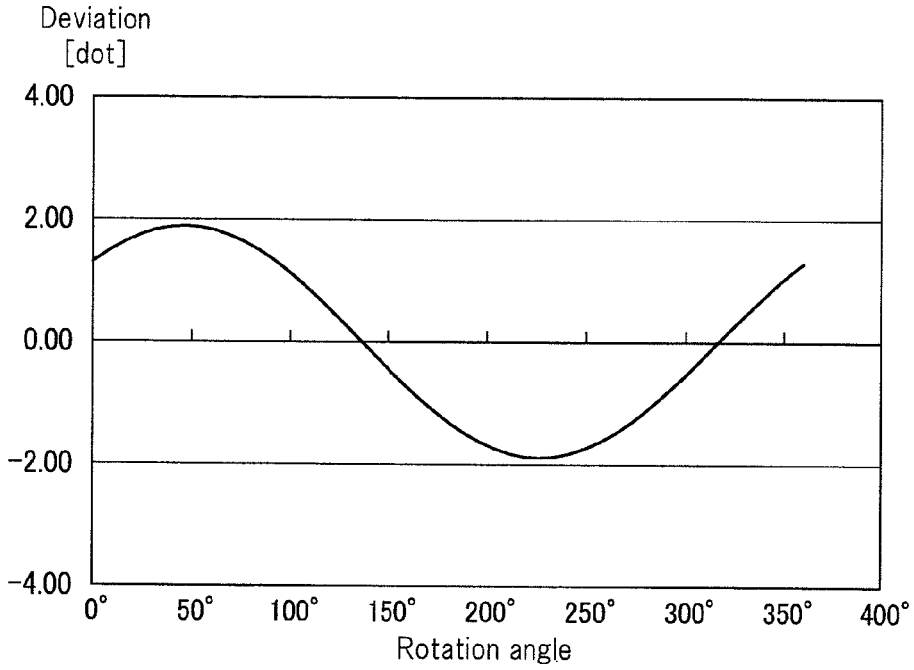
FIG. 14 is a graph representing, in a waveform, an equation of the cyan detection compressional wave obtained by a sine curve-fitting formula based on the deviations shown in FIG. 13.

If calculation is performed by applying data shown in FIG. 14 to Equations (6) to (10) and the table data TB in Table 1 that are stored in the storage means 320 in advance, the detection unit 302 will obtain the followings:

$$a=1.33$$

$$b=1.30$$

$$C(1)=1.86$$

$$\rho(1)=-1.3$$

$$\tau=44.3°$$

$$\tau(1)=44.3°$$

If these values are assigned to Equation (2) stored in the storage means 320 in advance, the cyan detection compressional wave $\alpha(1)$ is as follows:

$$\alpha(1)=1.86\times\sin(\epsilon(1)+44.3)-1.3$$

FIG. 14 is a graph representing the equation of the cyan detection compressional wave $\alpha(1)$ obtained by the sine curve-fitting formula based on the deviations shown in FIG. 13 into a waveform. Note that the sign curve shown in FIG. 14 is drawn with the shift amount $\rho(1)$ in the sub-scanning direction being 0, in order to clearly show that the wave is shifted by the phase angle $\tau(1)$ of 44.3°.

The equations of the black reference compressional wave $\alpha a$, the magenta detection compressional wave $\alpha(2)$, and the yellow detection compressional wave $\alpha(3)$ can also be obtained in the same manner as that for the cyan detection compressional wave $\alpha(1)$. Note that the compressional waves $\alpha a$ and $\alpha(i)$ have the same cycle.

In this way, the detection unit 302 can obtain the amplitude of the black reference compressional wave $\alpha a$ as the amplitude B of Equation (1), the amplitude of the cyan detection compressional wave $\alpha(1)$ as the amplitude C(1) of Equation (2), the amplitude of the magenta detection compressional wave $\alpha(2)$ as the amplitude C(2) of Equation (3), and further the amplitude of the yellow detection compressional wave $\alpha(3)$ as the amplitude C(3) of Equation (4), respectively.

Further, all the black reference compressional wave $\alpha a$, the cyan detection compressional wave $\alpha(1)$, the magenta detection compressional wave $\alpha(2)$, and the yellow detection compressional wave $\alpha(3)$ are at the normal positions of the black reference patterns Pa1, Pa2, and Pa3, the magenta detection patterns Pc1, Pc2, and Pc3, and the yellow detection patterns Pd1, Pd2, and Pd3 when their angles $\epsilon k$, $\epsilon(1)$, $\epsilon(2)$, and $\epsilon(3)$ are 0. Accordingly, the detection unit 302 can detect the relative phase angle of the cyan detection compressional wave $\alpha(1)$ relative to the black reference compressional wave $\alpha a$ as a deviation $(\tau k-\tau(1))$ between the phase angle $\tau k$ of Equation (1) and the phase angle $\tau(1)$ of Equation (2). Further, the detection unit 302 can detect the relative phase angle of the magenta detection compressional wave $\alpha(2)$ relative to the black reference compressional wave $\alpha a$ as a deviation $(\tau k-\tau(2))$ between the phase angle $\tau k$ of Equation (1) and the phase angle $\tau(2)$ of Equation (3). Furthermore, the detection unit 302 can detect the relative phase angle of the yellow detection compressional wave $\alpha(3)$ relative to the black reference compressional wave $\alpha a$ as a deviation $(\tau k-\tau(3))$ between the phase angle $\tau k$ of Equation (1) and the phase angle $\tau(3)$ of Equation (4).

Note that if the normal positions of the black reference patterns Pa1, Pa2, and Pa3, the magenta detection patterns Pc1, Pc2, and Pc3, and the yellow detection patterns Pd1, Pd2, and Pd3 are matched to the normal positions of the cyan detection patterns Pb1, Pb2, and Pb3, in consideration of the rotation angle $\psi$ with respect to the interval (distance h) between adjoining patterns, the black reference compressional wave $\alpha a$ is set to have the angle $\epsilon k=\epsilon(1)-\psi$, the magenta detection compressional wave $\alpha(2)$ is set to have the angle $\epsilon(2)=\epsilon(1)-2\times\psi$, and the yellow detection compressional wave $\alpha(3)$ is set to have the angle $\epsilon(3)=\epsilon(1)-3\times\psi$.

Although the sine curve-fitting formula is used in the present embodiment, by increasing the number of points S at which a pattern is created, one half of the difference between the maximal value of the obtained deviations $\Delta s$ and the minimal value thereof is detected as the amplitudes B and C(i), and the phase difference of the maximal values of the deviations $\Delta s$ of the cyan, magenta and yellow detection compressional waves with respect to the maximal value of the deviation $\Delta s$ of the black reference compressional wave (the maximal values in less than one cycle with respect to the maximal value of the black reference compressional wave) may be respectively detected as relative phase angles $\phi(i)$. Alternatively, the phase difference of the minimal values of the deviations $\Delta s$ of the cyan, magenta, and yellow detection compressional waves with respect to the minimal value of the deviation $\Delta s$ of the black reference compressional wave (the minimal values in less than one cycle with respect to the minimal value of the black reference compressional wave) may be respectively detected as relative phase angles $\phi(i)$.

Table 2 below shows an example in which the amplitude B of the black reference compressional wave $\alpha a$, the amplitudes C(1), C(2), and C(3) of the cyan detection compressional wave $\alpha(1)$, the magenta detection compressional wave $\alpha(2)$, and the yellow detection compressional wave $\alpha(3)$, and the relative phase angles $\phi(1)$, $\phi(2)$, and $\phi(3)$ of the cyan detection compressional wave $\alpha(1)$, the magenta detection compressional wave $\alpha(2)$, and the yellow detection compressional wave $\alpha(3)$ relative to the black reference compressional wave are detected using Equations (1) to (4).

TABLE 2

| | Black (K) | Cyan (C(1)) | Magenta (C(2)) | Yellow (C(3)) |
|---|---|---|---|---|
| Amplitude [dot] | 1.2 | 2.1 | 1.0 | 0.9 |
| Relative phase angle $\phi_{(i)}$ | | −46 | −209 | −38 |

Computing Unit

The computing unit 303 computes cyan, magenta, and yellow phase shift amounts A(i) that respectively indicate the relative phase shifts of rotational irregularity of the cyan, magenta, and yellow photosensitive drums 3*b* to 3*d* relative to rotational irregularity of the black photosensitive drum 3*a* for each of a plurality of correction relative phase angles θ(j) (note that j is an integer of one or more and n or less, and n is an integer of two or more) obtained by sequentially adding a unit angle θh set in advance from 0°, based on the amplitude B of the black reference compressional wave αa, the amplitudes C(i) of the cyan, magenta, and yellow detection compressional waves α(i), and the relative phase angles ϕ(i) of the cyan, magenta, and yellow detection compressional waves α(i) relative to the black reference compressional wave αa. Here, the unit angle θh is an angle serving as the basis used when the correction unit 305 performs correction. The unit angle θh is stored in the storage means 320 in advance.

Specifically, the computing unit 303 computes the cyan, magenta, and yellow phase shift amounts A(i) for each of the n correction relative phase angles θ(j) using the following equation. The following equation is stored in the storage means 320 in advance.

$$A(i)=\sqrt{(B^2+C(i)^2-2\times B\times C(i)\times\cos(\phi(i)+\theta(j)))}$$

In the present embodiment, the unit angle θh stored in the storage means 320 in advance is an angle obtained by equally dividing an angle corresponding to at least a single rotation of the photosensitive drums 3*a* to 3*d* into n (n is an integer of two or more). Specifically, n is set to 8, and the unit angle θh is an angle of 45° obtained by equally dividing 360° corresponding to a single rotation of the photosensitive drums 3*a* to 3*d* into eight. Therefore, the correction relative phase angles θ(1) to θ(8) obtained by adding the unit angle θh from 0° are 0°, 45°, 90°, 135°, 180°, 225°, 270°, and 315°, respectively.

Equation of Phase Shift Amount

Here, an equation of the phase shift amount A(i) is described. Note that below is a description with the relative phase shift amount A(1) of rotational irregularity of the cyan photosensitive drum 3*b* relative to rotational irregularity of the black photosensitive drum 3*a* serving as a representative. The relative phase shift amounts A(2) and A(3) of rotational irregularity of the magenta and yellow photosensitive drums 3*c* and 3*d* relative to rotational irregularity of the black photosensitive drum 3*a* are the same as the case of cyan, and thus description thereof is omitted here.

Figure 15A:
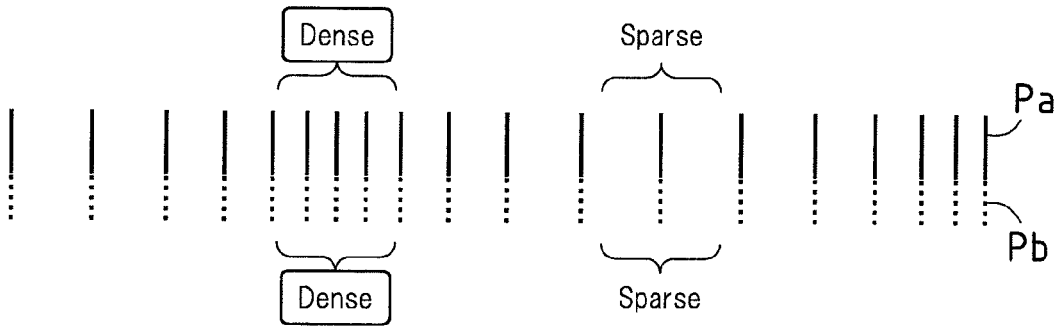
FIGS. 15A to 15D are explanatory diagrams for describing an equation of a phase shift amount, where

FIGS. 15A to 16B are explanatory diagrams for describing an equation of the phase shift amount A(i). FIG. 15A shows both the black reference pattern Pa and the cyan detection pattern Pb in the state where there is no relative phase shift between the black reference compressional wave αa and the cyan detection compressional wave α(1) in the case where the amplitudes thereof are the same. FIG. 15B shows both the black reference pattern Pa and the cyan detection pattern Pb in the state where there is a relative phase shift between the black reference compressional wave αa and the cyan detection compressional wave α(1) in the case where the amplitudes thereof are the same.

Figure 15B:
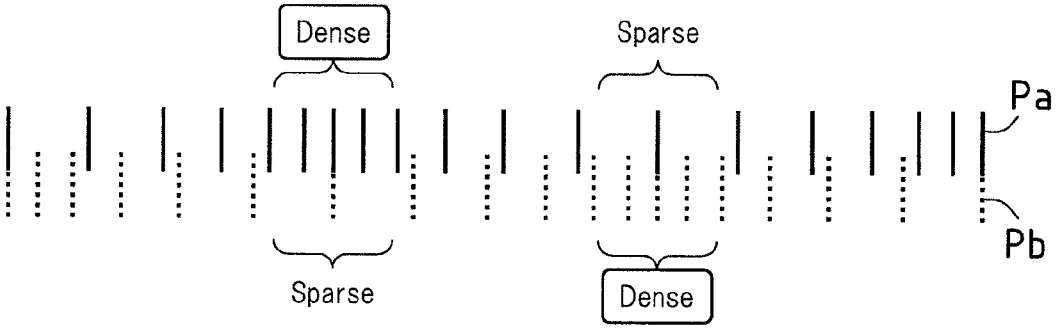

With the black reference pattern Pa and the cyan detection pattern Pb, a state of a wide pitch and a state of a narrow pitch periodically occur if there is rotational irregularity, as shown in FIGS. 15A and 15B. The black reference compressional wave αa and the cyan detection compressional wave α(1) respectively represent deviations of the pitches of the black reference pattern Pa and the cyan detection pattern Pb with respect to a normal pitch when there is no rotational irregularity.

If a relative phase shift between the black reference compressional wave αa and the cyan detection compressional wave α(1) becomes great as shown in FIG. 15B, the shift between the black reference pattern Pa and the cyan detection pattern Pb becomes extremely great, and consequently influence on an image becomes greater all the more.

Figure 15C:
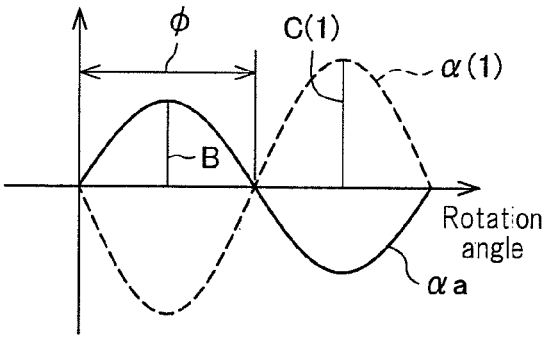
Figure 15D:
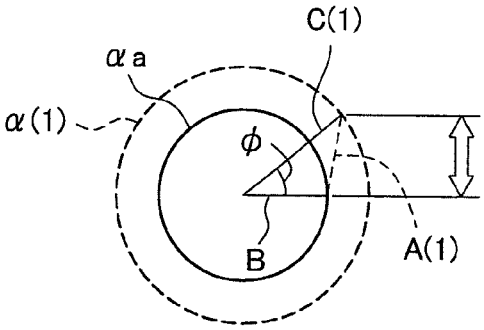

FIG. 15C shows the state where the cyan detection compressional wave α(1) having a different amplitude is shifted by the relative phase angle ϕ relative to the black reference compressional wave αa. In FIG. 15D, the black reference compressional wave αa and the cyan detection compressional wave α(1) shown in FIG. 15C are represented in circular movement.

Figure 16A:
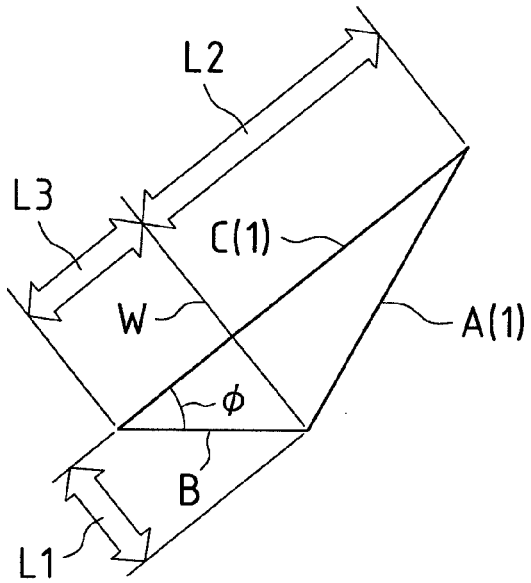
FIGS. 16A and 16B are explanatory diagrams for describing the equation of a phase shift amount, where

If the black reference compressional wave αa and the cyan detection compressional wave α(1) are represented as sine waves as shown in FIG. 15C, since a sine wave is a wave obtained by projecting a circular movement in the amplitude direction as shown in FIG. 15D, description can be given using the conceptual diagram shown in FIG. 16A.

FIG. 16A shows that the amplitude B of the black reference compressional wave αa, the amplitude C(1) of the cyan detection compressional wave α(1), and the relative phase angle ϕ have a relationship corresponding to two sides of a triangle and the angle formed thereby.

As shown in FIG. 16A, one side of a triangle represents the amplitude B of the black reference compressional wave αa, the other side represents the amplitude C(1) of the cyan detection compressional wave α(1), and the angle formed thereby represents the relative phase angle ϕ. The remaining side represents the relative phase shift amount A(1) of rotational irregularity of the cyan photosensitive drum 3*b* relative to rotational irregularity of the black photosensitive drum 3*a*.

This relative phase shift amount A(1) can be derived by the theorem of trigonometric functions, as shown below.

Specifically, if a perpendicular line W is drawn from the apex between the amplitude B and the relative phase shift amount A(1) toward the amplitude C(1), it is sufficient that the lengths of L1 and L2 of the right triangle having the relative phase shift amount A(1) as an oblique line are known, L1 and L2 being the remaining two sides, in order to obtain the relative phase shift amount A(1).

Among the two remaining sides L1 and L2, the length L1 of the side that constitutes the perpendicular line W is as follows:

$$L1=B\times\sin(\phi)$$

Here, among the amplitude C(1) divided by the perpendicular line W, if the length on the relative phase shift amount A(1) side is L2, and the length on the amplitude B side is L3, L2 and L3 are obtained as follows:

$$L3=B\times\cos(\phi)$$

$$L2=C(1)-L3=C(1)-B\times\cos(\phi)$$

The following holds true:

$$(L1)^2+(L2)^2=(A(1))^2$$

Thus, A(1) is obtained as follows:

$$A(1) = \sqrt{((L1)^2 + (L2)^2)}$$
$$= \sqrt{((B \times \sin\phi)^2 + (C(1) - B \times \cos(\phi))^2)}$$
$$= \sqrt{(B^2 + (C(1))^2 - 2 \times B \times C(1) \times \cos(\phi))}$$

Here, since the correction relative phase angle is θ(j), and the relative phase angle of the cyan detection compressional wave α(1) relative to the black reference compressional wave αa is ϕ(1), ϕ is as follows:

$$\phi=\phi(1)+\theta(j)$$

The equation of the relative phase shift amount A(1) of rotational irregularity of the cyan photosensitive drum 3*b* relative to rotational irregularity of the black photosensitive drum 3*a* when the wave is shifted by every correction relative phase angle θ(j) from the relative phase angle ϕ(1) is as follows:

$$A(1)=\sqrt{(B^2+C(1)^2-2\times B\times C(1)\times\cos(\phi(1)+\theta(j)))}$$

Figure 16B:
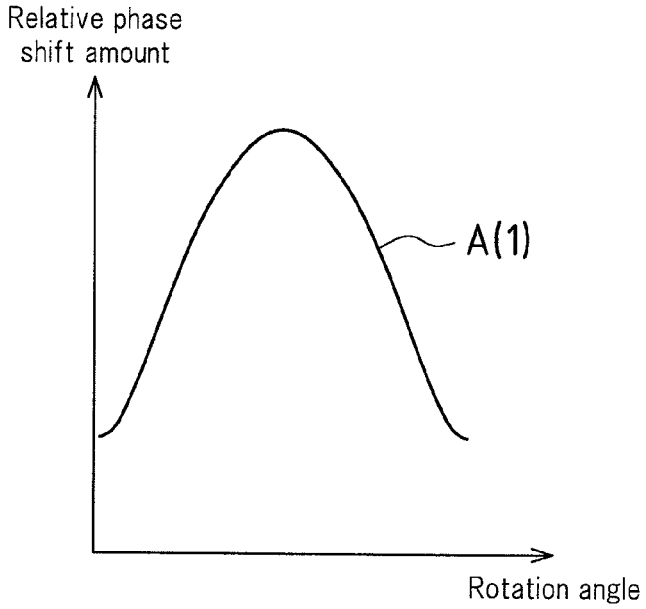

FIG. 16B shows an example of a waveform representing the relative phase shift amount A(1) of rotational irregularity of the cyan photosensitive drum 3*b* relative to rotational irregularity of the black photosensitive drum 3*a* when the relative phase angle ϕ(1) of the cyan detection compressional wave α(1) relative to the black reference compressional wave αa is 0°.

In the case where the relative phase angle ϕ(1) of the cyan detection compressional wave α(1) relative to the black reference compressional wave αa is 0°, as shown in FIG. 16B, the relative phase shift amount shows a minimal value when the correction relative phase angle θ(j) is 0°, and shows a maximal value when the correction relative phase angle θ(j) is 180°.

Similarly, the equations of the relative phase shift amounts A(2) and A(3) of rotational irregularity of the magenta and yellow photosensitive drums 3*c* and 3*d* relative to rotational irregularity of the black photosensitive drum 3*a* are as follows:

$$A(2)=\sqrt{(B^2+C(2)^2-2\times B\times C(2)\times\cos(\phi(2)+\theta(j)))}$$

$$A(3)=\sqrt{(B^2+C(3)^2-2\times B\times C(3)\times\cos(\phi(3)+\theta(j)))}$$

In this way, they can be represented by the equation of the phase shift amount A(i) as described above.

The computing unit 303 calculates the relative phase shift amounts A(1), A(2), and A(3) by assigning the amplitude B of the black reference compressional wave αa, the amplitudes C(1), C(2), and C(3) of the cyan detection compressional wave α(1), the magenta detection compressional wave α(2), and the yellow detection compressional wave α(3), and the relative phase angles ϕ(1), ϕ(2), and ϕ(3) of the cyan detection compressional wave α(1), the magenta detection compressional wave α(2), and the yellow detection compressional wave α(3) relative to the black reference compressional wave into the equations of the relative phase shift amounts A(1), A(2), and A(3) stored in the storage means 320 in advance.

For example, if the values in Table 2 are assigned into the equations of the relative phase shift amounts A(1), A(2), and A(3), the results in Table 3 below are obtained. Note that the unit of the amount of shift is dots in Table 3, and Tables 4 and 5 and FIGS. 17, 20A and 20B that will be described later.

TABLE 3

| J | Correction relative phase angle θ(j) | Cyan (A(1)) | Magenta (A(2)) | Yellow (A(3)) |
|---|---|---|---|---|
| 1 | 0° | 1.5 | 2.1 | 0.7 |
| 2 | 45° | 0.9 | 2.2 | 0.3 |
| 3 | 90° | 1.5 | 1.9 | 1.0 |
| 4 | 135° | 2.4 | 1.3 | 1.6 |
| 5 | 180° | 3.1 | 0.6 | 2.0 |
| 6 | 225° | 3.3 | 0.4 | 2.1 |
| 7 | 270° | 3.1 | 1.1 | 1.9 |
| 8 | 315° | 2.4 | 1.8 | 1.4 |

Figure 17:
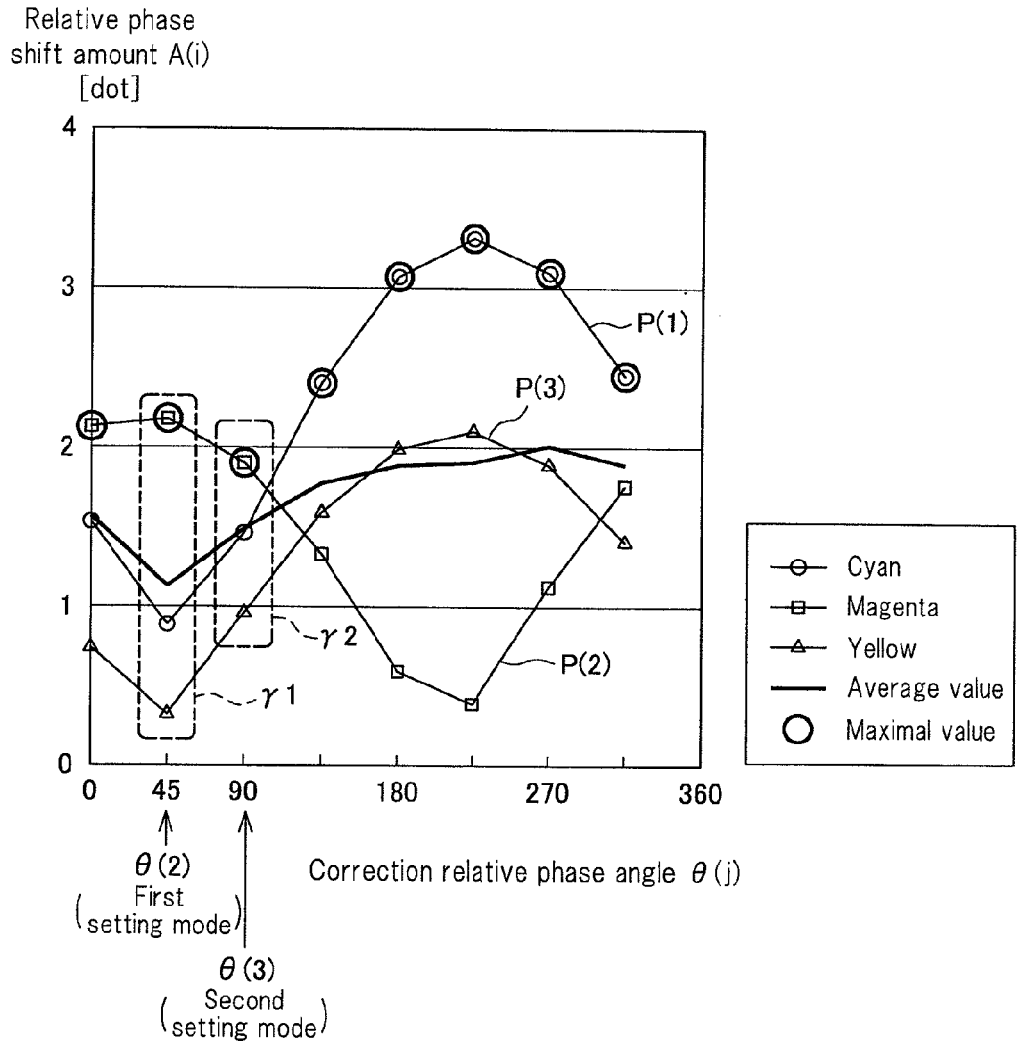
FIG. 17 is a line graph showing values shown in Table 3.

FIG. 17 is a line graph showing values shown in Table 3. As shown in FIG. 17, it can be seen that the phases of rotational irregularity of the cyan, magenta, and yellow photosensitive drums 3*b* to 3*d* in the second group photosensitive body 30*b* relative to rotational irregularity of the black photosensitive drum 3*a* are each relatively shifted.

In this case, although it is sufficient to adjust a relative phase shift of rotational irregularity of each of the cyan, magenta, and yellow photosensitive drums 3*b* to 3*d* with respect to rotational irregularity of the black photosensitive drum 3*a*, since the cyan, magenta, and yellow photosensitive drums 3*b* to 3*d* rotate in coordination with each other, the relative phase shifts cannot be adjusted separately. Accordingly, it is necessary to optimally correct relative phase shifts of rotational irregularity of the cyan, magenta, and yellow photosensitive drums 3*b* to 3*d* in the second group photosensitive body 30*b* relative to rotational irregularity of the black photosensitive drum 3*a*.

Setting Unit

The setting unit 304 specifies the phase shift amounts A(1), A(2), and A(3) of rotational irregularity of the cyan, magenta, and yellow photosensitive drums 3*b* to 3*d* that have been computed for every correction relative phase angle θ(j), and moreover sets the correction relative phase angle θ(j) corresponding to the specified phase shift amounts.

Specifically, the setting unit 304 sets, based on the phase shift amounts A(1), A(2), and A(3), the correction relative phase angle θ(j) for optimally correcting relative phase shifts of rotational irregularity of the cyan, magenta, and yellow photosensitive drums 3*b* to 3*d* relative to rotational irregularity of the black photosensitive drum 3*a* in a first or second setting mode below. Note that the first setting mode and the second setting mode can be selectively switched.

First Setting Mode

In a first setting mode, the computing unit 303 calculates an average value for every correction relative phase angle θ(j) with respect to the phase shift amounts A(1), A(2), and A(3) due to rotational irregularity of the cyan, magenta, and yellow photosensitive drums 3*b* to 3*d*. Table 4 below shows average values for every correction relative phase angle θ(j) with respect to the results in Table 3.

TABLE 4

| J | θ (j) | Cyan (A(1)) | Magenta (A(2)) | Yellow (A(3)) | Average value |
|---|---|---|---|---|---|
| 1 | 0° | 1.5 | 2.1 | 0.7 | 1.5 |
| 2 | 45° | 0.9 | 2.2 | 0.3 | 1.1 |
| 3 | 90° | 1.5 | 1.9 | 1.0 | 1.4 |
| 4 | 135° | 2.4 | 1.3 | 1.6 | 1.8 |
| 5 | 180° | 3.1 | 0.6 | 2.0 | 1.9 |
| 6 | 225° | 3.3 | 0.4 | 2.1 | 1.9 |
| 7 | 270° | 3.1 | 1.1 | 1.9 | 2.0 |
| 8 | 315° | 2.4 | 1.8 | 1.4 | 1.9 |

← Minimal value

Next, the setting unit 304 sets the correction relative phase angle θ(j) (45° in the example in Table 4) corresponding to a minimal value (1.1 dots in the example in Table 4) among the average values for every correction relative phase angle θ(j) calculated by the computing unit 303 so as to be the optimal correction relative phase angle θ(j) (j=2, see γ1 in FIG. 17).

Second Setting Mode

In a second setting mode, the computing unit 303 calculates a maximal value for every correction relative phase angle θ(j) with respect to the phase shift amounts A(1), A(2), and A(3) of rotational irregularity of the cyan, magenta, and yellow photosensitive drums 3*b* to 3*d*. Table 5 below shows maximal values for every correction relative phase angle θ(j) with respect to the results in Table 3.

TABLE 5

| J | θ (j) | Cyan (A(1)) | Magenta (A(2)) | Yellow (A(3)) | Maximal value |
|---|---|---|---|---|---|
| 1 | 0° | 1.5 | 2.1 | 0.7 | 2.1 |
| 2 | 45° | 0.9 | 2.2 | 0.3 | 2.2 |
| 3 | 90° | 1.5 | 1.9 | 1.0 | 1.9 |
| 4 | 135° | 2.4 | 1.3 | 1.6 | 2.4 |
| 5 | 180° | 3.1 | 0.6 | 2.0 | 3.1 |
| 6 | 225° | 3.3 | 0.4 | 2.1 | 3.3 |
| 7 | 270° | 3.1 | 1.1 | 1.9 | 3.1 |
| 8 | 315° | 2.4 | 1.8 | 1.4 | 2.4 |

← Minimal value

Next, the setting unit 304 sets the correction relative phase angle θ(j) (90° in the example in Table 5) corresponding to a minimal value (1.9 dots in the example in Table 5) among the maximal values for every correction relative phase angle θ(j) calculated by the computing unit 303 so as to be the optimal correction relative phase angle θ(j) (j=3, see γ2 in FIG. 17).

The optimal correction relative phase angle θ(j) set in the first or second setting mode is stored in the storage means 320.

Correction Unit

The correction unit 305 corrects a relative phase shift between rotational irregularity of the black photosensitive drum 3*a* and rotational irregularity of the second group photosensitive body 30*b* based on the optimal correction relative phase angle θ(j) stored in the storage means 320 (45° (j=2) in the example in Table 4, 90° (j=3) in the example in Table 5) by operationally controlling at least one of the first and second drive units 110 and 120.

Rotation Phase Adjustment of Photosensitive Drums

Figure 18:
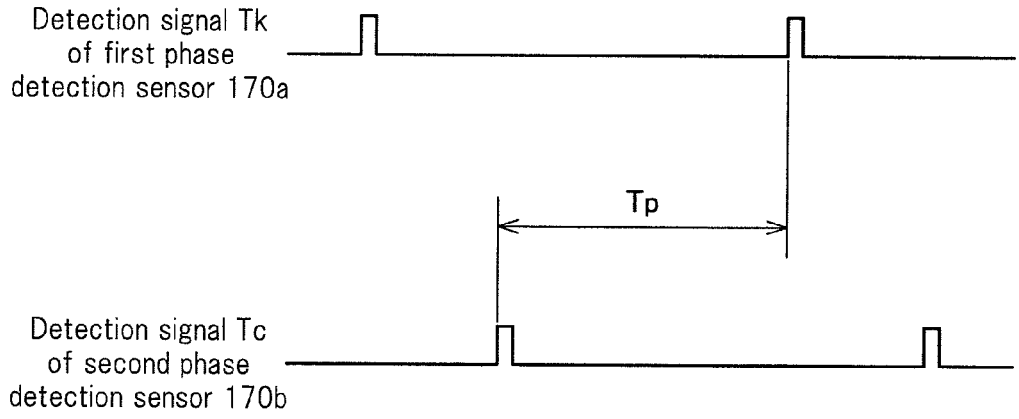
FIG. 18 is a timing chart showing detection signals of first and second phase detection sensors.

FIG. 18 is a timing chart showing detection signals of the first and second phase detection sensors 170*a* and 170*b*.

The correction unit 305 corrects a relative phase shift between rotational irregularity of the black photosensitive drum 3*a* and rotational irregularity of the second group photosensitive body 30*b* by adjusting a detection time Tp between a detection signal Tk of the first phase detection sensor 170*a* that detects the phase of the black photosensitive drum 3*a* and a detection signal Tc of the second phase detection sensor 170*b* that detects the phase of the second group photosensitive body 30*b*, as shown in FIG. 18.

Figure 19A:
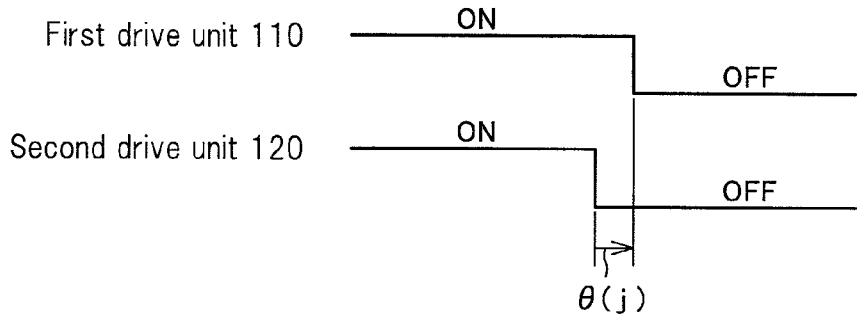
FIGS. 19A to 19C are timing charts showing operation timing of an output signal to a second driving unit that drives a second group photosensitive body with respect to an output signal to a first driving unit that drives the black photosensitive drum, where FIGS. 19A and 19B respectively showing a state in which the phase of the second group photosensitive body has advanced by an optimal relative phase angle relative to the phase of the black photosensitive drum and a state in which it has lagged.
Figure 19B:
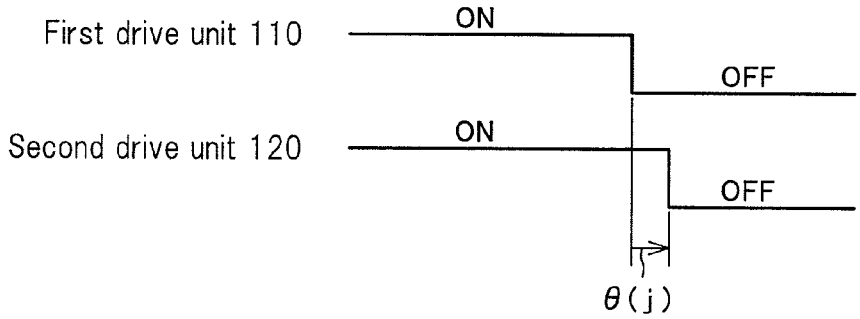
Figure 19C:
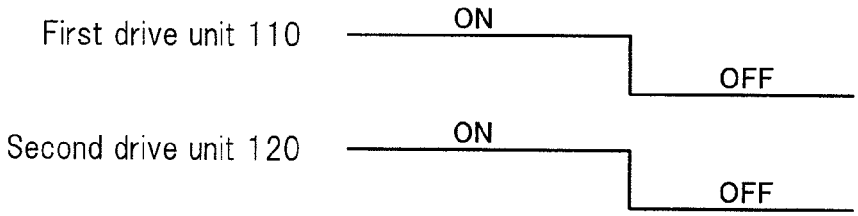

Specifically, the correction unit 305 executes a stop operation for adjusting a timing for stopping the first and second drive units 110 and 120 after image formation, which is shown in FIGS. 19A to 19C.

FIGS. 19A to 19C are timing charts showing an operation timing of an output signal to the second drive unit 120 that drives the second group photosensitive body 30*b* with respect to an output signal to the first drive unit 110 that drives the black photosensitive drum 3*a*. FIGS. 19A and 19B respectively show a state in which the phase of the second group photosensitive body 30*b* has advanced by the optimal relative phase angle θ(j) relative to the phase of the black photosensitive drum 3*a* and the state in which it has lagged. Further, FIG. 19C shows a state after correcting a relative phase shift between rotational irregularity of the black photosensitive drum 3*a* and rotational irregularity of the second group photosensitive body 30*b*.

For example, as shown in FIG. 19A, if in the state in which the phase of the second group photosensitive body 30*b* has advanced by the optimal relative phase angle θ(j) relative to the phase of the black photosensitive drum 3*a*, the relative phase shift between rotational irregularity of the black photosensitive drum 3*a* and rotational irregularity of the second group photosensitive body 30*b* can be properly corrected by performing an operation of stopping the second drive unit 120 earlier than an operation of stopping the first drive unit 110 by θ(j), as shown in FIG. 19C.

On the contrary, as shown in FIG. 19B, if in the state in which the phase of the second group photosensitive body 30*b* has lagged by the optimal relative phase angle θ(j) relative to the phase of the black photosensitive drum 3*a*, the relative phase shift between rotational irregularity of the black photosensitive drum 3*a* and rotational irregularity of the second group photosensitive body 30*b* can be properly corrected by performing an operation of stopping the second drive unit 120 later than an operation of stopping the first drive unit 110 by θ(j), as shown in FIG. 19C.

Note that the relative phase shift between rotational irregularity of the black photosensitive drum 3*a* and rotational irregularity of the second group photosensitive body 30*b* may be corrected by stopping either one of the black photosensitive drum 3*a* and the second group photosensitive body 30*b*, and thereafter similarly performing correction based on θ(j) on the other and stopping it after k rotations (k is an integer of two or more).

If in the state where the relative phase angle of the second group photosensitive body 30*b* is optimal with respect to the black photosensitive drum 3*a*, both of them are simultaneously stopped as shown in FIG. 19C. Alternatively, either one of the black photosensitive drum 3*a* and the second group photosensitive body 30*b* is stopped, and thereafter the other is stopped after k rotations, thereby enabling both of them to be stopped without changing the relative phase relationship between the black photosensitive drum 3*a* and the second group photosensitive body 30*b*.

As described above, according to the color image forming apparatus D according to the present embodiment, the computing unit 303 computes the phase shift amounts A(i) respectively indicating the relative phase shifts of rotational irregularity of the cyan, magenta, and yellow photosensitive drums 3*b* to 3*d* in the second group photosensitive body 30*b* relative to rotational irregularity of the black photosensitive drum 3*a* for every correction relative phase angle θ(j), based on the amplitude B of the black reference compressional wave αa, the amplitudes C(i) of the cyan, magenta, and yellow detection compressional waves α(i), and the relative phase angles ϕ(i) of the cyan, magenta, and yellow detection compressional waves α(i) relative to the black reference compressional wave αa. The setting unit 304 sets the correction relative phase angle θ(j) corresponding to the phase shift amounts A(i) obtained by specifying the phase shift amounts A(i) computed for every correction relative phase angle θ(j). The correction unit 305 operationally controls at least one of the first and second drive units 110 and 120 based on the correction relative phase angle θ(j) set by the setting unit 304, thereby correcting a relative phase shift between rotational irregularity of the black photosensitive drum 3*a* and rotational irregularity of the second group photosensitive body 30*b*. Consequently, the relative phase shift between rotational irregularity of the black photosensitive drum 3*a* and rotational irregularity of the second group photosensitive body 30*b* can be optimally corrected.

The plurality of phase shift amounts A(i) can be obtained by the simple computing equation described above $[\sqrt{(B^2+C(i)^2-2\times B\times C(i)\times\cos(\phi(i)+\theta(j)))}]$, and thus it is possible to realize further facilitation of the computational configuration for computation.

In the first setting mode, the optimal correction relative phase angle θ(j) can be easily set by only selecting the minimal value among the average values calculated for every correction relative phase angle θ(j) with respect to the phase shift amounts A(i), and thus it is possible to realize further facilitation of the computational configuration for computation. In the second setting mode, the optimal correction relative phase angle θ(j) can be easily set by only selecting the minimal value among the maximal values calculated for every correction relative phase angle θ(j) with respect to the phase shift amounts A(i), and thus it is possible to realize further facilitation of the computational configuration for computation.

The phase shift amounts A(i) can be accurately obtained by setting the correction relative phase angle θ(j) so as to be an angle obtained by equally dividing the angle corresponding to at least a single rotation of the photosensitive drums 3*a* to 3*d*.

The first group photosensitive body 30*a* is for performing black image formation, and the second group photosensitive body 30*b* is for performing color image formation. Thus, it is possible to effectively improve image quality of black character originals on which characters are normally printed.

Figure 20A:
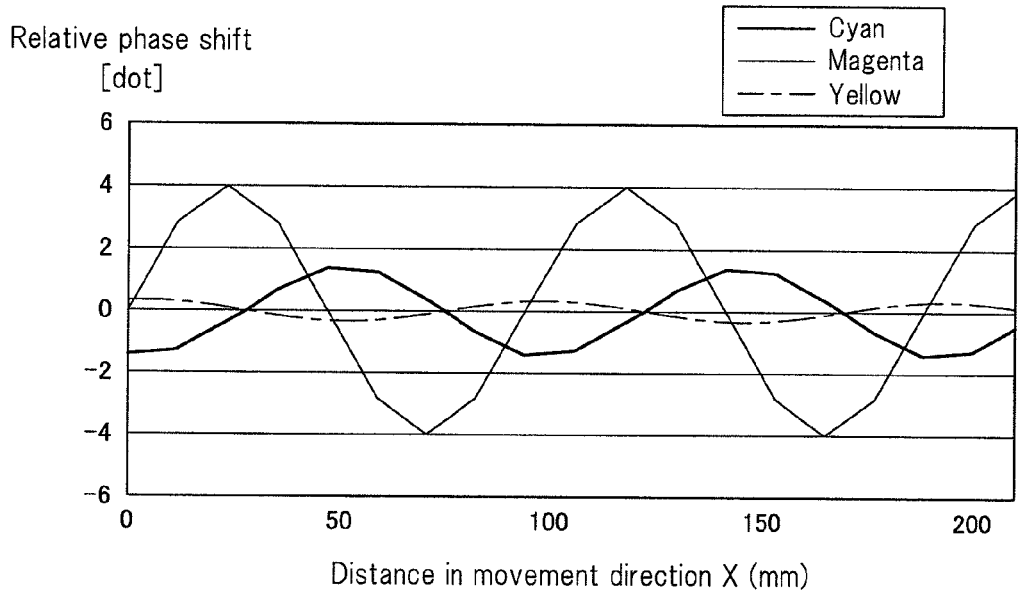
FIGS. 20A and 20B show examples of graphs of cyan, magenta and yellow detection compressional waves a with respect to the black reference compressional wave, after correcting a relative phase shift between rotational irregularity of the black photosensitive drum and rotational irregularity of the second group photosensitive body, where
Figure 20B:
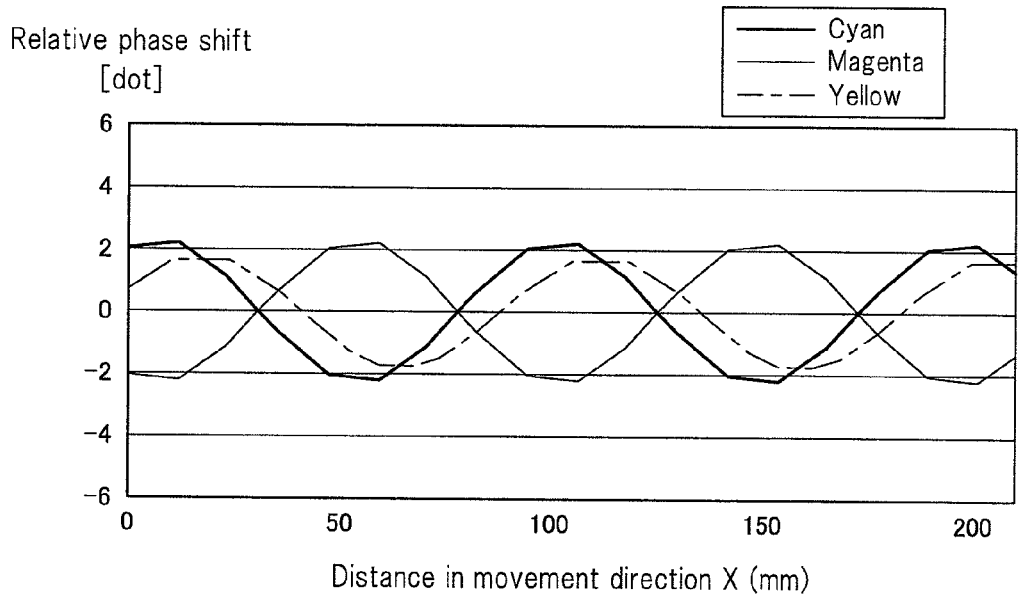

FIGS. 20A and 20B are examples of graphs showing the cyan, magenta, and yellow detection compressional waves α(i) with respect to the black reference compressional wave αa after a relative phase shift between rotational irregularity of the black photosensitive drum 3*a* and rotational irregularity of the second group photosensitive body 30*b* has been corrected. FIG. 20A is a graph showing the result of correction in the first setting mode, and FIG. 20B is a graph showing the result of correction in the second setting mode. In FIGS. 20A and 20B, the horizontal axis shows the distance in the movement direction X of the intermediate transfer belt 7. Note that the examples shown in FIGS. 20A and 20B are different from examples shown in Tables 4 and 5 and FIG. 17.

As shown in FIGS. 20A and 20B, if the values of the relative phase angle θ(j) are different in the first and second setting modes, the shift amounts of position displacement of cyan, magenta, and yellow with respect to black are different in the distance in the movement direction X of the intermediate transfer belt 7.

In this point, in the present embodiment, the first setting mode and the second setting mode can be selectively switched. Thus, according to the state of relative phase shifts of rotational irregularity between the cyan, magenta, and yellow photosensitive drums 3*b* to 3*d* in the second group photosensitive body 30*b* or the balance of relative phase shifts between rotational irregularity of the second group photosensitive body 30*b* and rotational irregularity of the black photosensitive drum 3*a*, correction in the first setting mode and correction in the second setting mode can be properly used so as to achieve a more nearly optimal correction state.

The present invention may be embodied in various other forms without departing from the spirit or essential characteristics thereof. Therefore, the embodiments disclosed herein are to be considered in all respects as illustrative and not limiting. The scope of the invention is indicated by the appended claims rather than by the foregoing description. All variations and modifications that come within the meaning and range of equivalency of the claims are intended to be embraced therein.

What is claimed is:

1. An image forming apparatus that includes a first group image bearing member including a first image bearing member among a plurality of image bearing members each forming a plurality of images, and a second group image bearing member including a plurality of second image bearing members among remaining image bearing members, the plurality of second image bearing members rotating in coordination with each other, the image forming apparatus stacking the plurality of images on a recording medium, and comprising:

a first drive unit that rotates the first group image bearing member at a fixed circumferential speed;

a second drive unit that rotates the second group image bearing member at the circumferential speed;

a pattern formation unit that forms a reference pattern corresponding to the first image bearing member on the recording medium at a pitch in a circumferential direction, and forms a plurality of detection patterns respectively corresponding to the plurality of second image bearing members on the recording medium at the pitch;

a detection unit that detects an amplitude of a reference compressional wave representing a periodic change in an amount of position displacement indicating position displacement in the circumferential direction due to the circumferential speed in the reference pattern, detects an amplitude of each of a plurality of detection compressional waves respectively representing a periodic change in an amount of position displacement indicating position displacement in the circumferential direction due to the circumferential speed in the plurality of detection patterns, and further detects a relative phase angle of each of the plurality of detection compressional waves relative to the reference compressional wave;

a computing unit that computes, based on the amplitude of the reference compressional wave, the amplitudes of the plurality of detection compressional waves, and the relative phase angles of the plurality of detection compressional waves relative to the reference compressional wave, a plurality of phase shift amounts respectively indicating a relative phase shift of a periodic variation in the circumferential speed of the plurality of second image bearing members in the second group image bearing member relative to a periodic variation in the circumferential speed of the first image bearing member for each of a plurality of correction relative phase angles obtained by sequentially adding a unit angle set in advance;

a setting unit that specifies the plurality of phase shift amounts computed for each of the plurality of correction relative phase angles, and sets a correction relative phase angle corresponding to the specified phase shift amounts; and a correction unit that corrects, based on the correction relative phase angle set by the setting unit, a relative phase shift between the periodic variation in the circumferential speed of the first image bearing member and the periodic variation in the circumferential speed of the second group image bearing member by operationally controlling at least one of the first and second drive units.

2. The image foaming apparatus according to claim 1, wherein when the amplitude of the reference compressional wave is B, the amplitude of each of the plurality of detection compressional waves is C(i) (i being an integer of one or more and m or less, and m being an integer of two or more), the relative phase angle of each of the plurality of detection compressional waves relative to the reference compressional wave is $\phi(i)$, and the plurality of correction relative phase angles are $\phi(j)$ (j being an integer of one or more and n or less, and n being an integer of two or more), the computing unit computes the plurality of phase shift amounts A(i) for each of the plurality of correction relative phase angles using an equation as follows:

$$A(i)=\sqrt{(B^2+C(i)^2-2\times B\times C(i)\times\cos(\phi(i)+\theta(j)))}.$$

3. The image forming apparatus according to claim 1, wherein the computing unit calculates an average value for each of the plurality of correction relative phase angles with respect to the plurality of phase shift amounts, and the setting unit sets a correction relative phase angle corresponding to a minimal value among the average values for the plurality of correction relative phase angles calculated by the computing unit.

4. The image forming apparatus according to claim 1, wherein the computing unit calculates a maximal value for each of the plurality of correction relative phase angles with respect to the plurality of phase shift amounts, and the setting unit sets a correction relative phase angle corresponding to a minimal value among the maximal values for the plurality of correction relative phase angles calculated by the computing unit.

5. The image forming apparatus according to claim 1, wherein the unit angle is an angle obtained by equally dividing an angle corresponding to at least a single rotation of the image bearing members.

6. The image forming apparatus according to claim 1, wherein the first group image bearing member is for performing black image formation, and the second group image bearing member is for performing color image formation.

* * * * *

UNITED STATES PATENT AND TRADEMARK OFFICE

CERTIFICATE OF CORRECTION

PATENT NO. : 8,452,209 B2
APPLICATION NO. : 13/005668
DATED : May 28, 2013
INVENTOR(S) : Norio Tomita et al.

It is certified that error appears in the above-identified patent and that said Letters Patent is hereby corrected as shown below:

IN THE CLAIMS:

At column 34, line 30, immediately following claim 6, insert the following claims:

-- 7. The image forming apparatus according to claim 2,
wherein the computing unit calculates an average value for each of the plurality of correction relative phase angles with respect to the plurality of phase shift amounts, and the setting unit sets a correction relative phase angle corresponding to a minimal value among the average values for the plurality of correction relative phase angles calculated by the computing unit.

8. The image forming apparatus according to claim 2,
wherein the computing unit calculates a maximal value for each of the plurality of correction relative phase angles with respect to the plurality of phase shift amounts, and the setting unit sets a correction relative phase angle corresponding to a minimal value among the maximal values for the plurality of correction relative phase angles calculated by the computing unit.

9. The image forming apparatus according to claim 2,
wherein the unit angle is an angle obtained by equally dividing an angle corresponding to at least a single rotation of the image bearing members.

10. The image forming apparatus according to claim 2,
wherein the first group image bearing member is for performing black image formation, and the second group image bearing member is for performing color image formation. --

Signed and Sealed this
Seventeenth Day of September, 2013

Teresa Stanek Rea
*Deputy Director of the United States Patent and Trademark Office*

UNITED STATES PATENT AND TRADEMARK OFFICE

CERTIFICATE OF CORRECTION

PATENT NO. : 8,452,209 B2
APPLICATION NO. : 13/005668
DATED : May 28, 2013
INVENTOR(S) : Norio Tomita et al.

It is certified that error appears in the above-identified patent and that said Letters Patent is hereby corrected as shown below:

Delete the title page and substitute therefore with the attached title page showing the corrected number of claims in patent.

IN THE CLAIMS:

At column 34, line 30, immediately following claim 6, insert the following claims:

-- 7. The image forming apparatus according to claim 2,
wherein the computing unit calculates an average value for each of the plurality of correction relative phase angles with respect to the plurality of phase shift amounts, and the setting unit sets a correction relative phase angle corresponding to a minimal value among the average values for the plurality of correction relative phase angles calculated by the computing unit.

8. The image forming apparatus according to claim 2,
wherein the computing unit calculates a maximal value for each of the plurality of correction relative phase angles with respect to the plurality of phase shift amounts, and the setting unit sets a correction relative phase angle corresponding to a minimal value among the maximal values for the plurality of correction relative phase angles calculated by the computing unit.

9. The image forming apparatus according to claim 2,
wherein the unit angle is an angle obtained by equally dividing an angle corresponding to at least a single rotation of the image bearing members.

10. The image forming apparatus according to claim 2,
wherein the first group image bearing member is for performing black image formation, and the second group image bearing member is for performing color image formation. --

This certificate supersedes the Certificate of Correction issued September 17, 2013.

Signed and Sealed this
Eighth Day of October, 2013

Teresa Stanek Rea
*Deputy Director of the United States Patent and Trademark Office*

(12) United States Patent
Tomita et al.

(10) Patent No.: US 8,452,209 B2
(45) Date of Patent: May 28, 2013

(54) IMAGE FORMING APPARATUS

(75) Inventors: Norio Tomita, Osaka (JP); Yoshikazu Harada, Osaka (JP); Yoshiteru Kikuchi, Osaka (JP); Kohichi Yamauchi, Osaka (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 322 days.

(21) Appl. No.: 13/005,668

(22) Filed: Jan. 13, 2011

(65) Prior Publication Data

US 2011/0170886 A1 Jul. 14, 2011

(30) Foreign Application Priority Data

Jan. 14, 2010 (JP) ..... 2010-005771

(51) Int. Cl.
*G03G 15/00* (2006.01)

(52) U.S. Cl.
USPC ..... 399/167; 399/53; 399/38; 399/76

(58) Field of Classification Search
CPC ..... G03G 15/30
USPC ..... 399/167, 75, 76, 53, 77, 38
See application file for complete search history.

(56) References Cited

U.S. PATENT DOCUMENTS

| | | | | |
|---|---|---|---|---|
| 7,587,157 | B2 | 9/2009 | Matsuda et al. | |
| 2009/0252540 | A1* | 10/2009 | Tomita et al. | 399/301 |
| 2009/0317148 | A1* | 12/2009 | Ikeda et al. | 399/301 |

FOREIGN PATENT DOCUMENTS

| | | | |
|---|---|---|---|
| JP | 2001-350300 | A | 12/2001 |
| JP | 2004-295094 | A | 10/2004 |
| JP | 2007-226206 | A | 9/2007 |
| JP | 2007-304250 | A | 11/2007 |
| JP | 2008-250124 | A | 10/2008 |

* cited by examiner

*Primary Examiner* — Walter L Lindsay, Jr.
*Assistant Examiner* — Roy Y Yi
(74) *Attorney, Agent, or Firm* — Birch, Stewart, Kolasch & Birch, LLP

(57) ABSTRACT

In an image forming apparatus, a computing unit computes phase shift amounts A(i) for every correction relative phase angle θ(j) based on an amplitude B of a reference compressional wave αa, an amplitude C(i) of a detection compressional wave α(i), and a relative phase angle φ(i). A setting unit specifies the phase shift amounts A(i), and sets a correction relative phase angle θ(j) corresponding to the specified phase shift amounts A(i). A correction unit corrects, based on the correction relative phase angle θ(j) set by the setting unit, a relative phase shift between a periodic variation in the circumferential speed of a first image bearing member and a periodic variation in the circumferential speed of a second group image bearing member by operationally controlling at least one of first and second drive units.

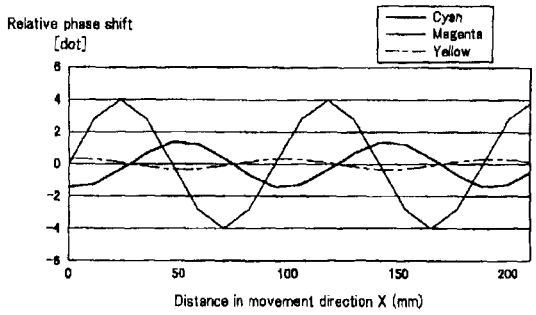

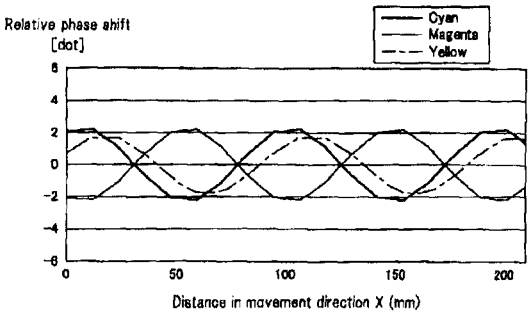

10 Claims, 17 Drawing Sheets